US011241690B2

(12) United States Patent
Noguchi et al.

(10) Patent No.: US 11,241,690 B2
(45) Date of Patent: Feb. 8, 2022

(54) FIBER ROD, BLOOD COLLECTION INSTRUMENT, AND BLOOD TEST KIT

(71) Applicant: FUJIFILM Corporation, Tokyo (JP)

(72) Inventors: Osamu Noguchi, Kanagawa (JP); Shinya Sugimoto, Tokyo (JP)

(73) Assignee: FUJIFILM Corporation, Tokyo (JP)

( * ) Notice: Subject to any disclaimer, the term of this patent is extended or adjusted under 35 U.S.C. 154(b) by 486 days.

(21) Appl. No.: 16/391,336

(22) Filed: Apr. 23, 2019

(65) Prior Publication Data

US 2019/0351407 A1 Nov. 21, 2019

(30) Foreign Application Priority Data

May 15, 2018 (JP) ..... JP2018-093813

(51) Int. Cl.
*B01L 3/00* (2006.01)

(52) U.S. Cl.
CPC ..... *B01L 3/5082* (2013.01); *B01L 2300/0832* (2013.01)

(58) Field of Classification Search
CPC ..... B01L 3/5082; B01L 2300/0832; B01L 2300/12; B01L 2200/026; B01L 2300/041; B01L 2300/0681; B01L 2300/069; B01L 3/5029
See application file for complete search history.

(56) References Cited

U.S. PATENT DOCUMENTS

| | | | | |
|---|---|---|---|---|
| 4,810,394 | A * | 3/1989 | Masuda | B01D 24/00 210/491 |
| 10,746,723 | B2 | 8/2020 | Yamashita et al. | |
| 2003/0175167 | A1 | 9/2003 | Takanori et al. | |
| 2012/0077261 | A1 | 3/2012 | Hirose et al. | |
| 2014/0018701 | A1 | 1/2014 | Mao et al. | |
| 2014/0249451 | A1 | 9/2014 | Mao et al. | |
| 2015/0079614 | A1 | 3/2015 | Mao et al. | |
| 2015/0185211 | A1 | 7/2015 | Mao et al. | |
| 2016/0349153 | A1 | 12/2016 | Mao et al. | |

FOREIGN PATENT DOCUMENTS

| | | |
|---|---|---|
| JP | S6138608 | 2/1986 |
| JP | 2003270239 | 9/2003 |
| JP | 2014515108 | 6/2014 |
| JP | 2015158502 | 9/2015 |
| JP | 2017015713 | 1/2017 |
| WO | 2010126011 | 11/2010 |

OTHER PUBLICATIONS

"Office Action of Japan Counterpart Application", dated Jun. 4, 2021, with English translation thereof, p. 1-p. 4.

* cited by examiner

*Primary Examiner* — Dennis White
(74) *Attorney, Agent, or Firm* — JCIPRNET

(57) ABSTRACT

Provided are a fiber rod, a blood collection instrument, and a blood test kit, which are capable of easily taking out a blood specimen.

A fiber rod which is used in a blood collection instrument in a blood test kit, including a fiber portion which is composed of a first fiber and a second fiber having different fiber diameters and which has a void volume within a range of 90% to 97%, in which a distance between surfaces facing each other of the fiber portion includes a region within a range of 1 mm to 1.6 mm.

9 Claims, 17 Drawing Sheets

FIBER ROD, BLOOD COLLECTION INSTRUMENT, AND BLOOD TEST KIT

CROSS-REFERENCE TO RELATED APPLICATIONS

The present application claims priority under 35 U.S.C. § 119 to Japanese Patent Application No. 2018-093813, filed on May 15, 2018. The above application is hereby expressly incorporated by reference, in its entirety, into the present application.

BACKGROUND OF THE INVENTION

1. Field of the Invention

The present invention relates to a fiber rod, a blood collection instrument, and a blood test kit.

2. Description of the Related Art

In general, blood collection includes general blood collection in which a certain qualified person such as a doctor collects blood from a vein using a syringe, and self-blood collection in which a test subject collects blood by piercing his finger or the like using a blood collecting needle.

Blood collected by general blood collection is transported to a medical institution or a test institute where tests are conducted, in a state of being sealed in a blood collection container. In a case of transporting a blood specimen without separating the blood into blood cells and plasma, a test is conducted after separating the blood specimen into blood cells and plasma by a centrifuge at a medical institution or a test institute. In addition, in a case of the self-blood collection performed by a test subject, a blood specimen after blood collection is separated into blood cells and plasma by a separation membrane, and then is transported to a test site where tests are conducted, in this separated state.

In order to self-collect a blood specimen, blood collection instruments are used in many cases. For example, JP2015-158502A discloses a blood collection instrument including a sintered porous plastic nib and a housing configured to be able to separate this nib. In JP2015-158502A, the nib has a thin tube shape so that a blood specimen can be collected by capillary force.

SUMMARY OF THE INVENTION

After self-blood collection by the blood collection instrument, it is necessary to release a blood specimen from the nib of the blood collection instrument in order to separate the collected blood specimen into blood cells and plasma.

However, in JP2015-158502A, because the blood specimen is collected by a capillary force, the blood specimen is not easily taken out from the sintered porous plastic nib.

The present invention has been made in view of the above circumstances, and an object thereof is to provide a fiber rod, a blood collection instrument, and a blood test kit, which can easily take out a blood specimen.

A fiber rod according to a first aspect is a fiber rod which is used in a blood collection instrument in a blood test kit, the fiber rod comprising a fiber portion which is composed of a first fiber and a second fiber having different fiber diameters and which has a void volume within a range of 90% to 97%, in which a distance between surfaces facing each other of the fiber portion includes a region within a range of 1 mm to 1.6 mm.

In the fiber rod according to a second aspect, the fiber portion has a hollow structure defining a space therein, and a ratio of a volume of the space to a volume of the fiber portion is within a range of 0.4 to 1.0.

In the fiber rod according to a third aspect, a space is a through-hole.

In the fiber rod according to a fourth aspect, the first fiber has a fiber diameter of 22 μm to 29 μm, and the second fiber has a fiber diameter of 14 μm to 21 μm.

In the fiber rod according to a fifth aspect, the first fiber and the second fiber are polyester fibers.

A blood collection instrument according to a sixth aspect, which is used in a blood test kit, the blood collection instrument comprising: a case in which an opening is defined on one side; and the above-described fiber rod, which is attachably and detachably held on the opening side, in an inside of the case.

In the blood collection instrument according to a seventh aspect, the case includes a member along an axial direction, and the member and the fiber rod form a flow path of a blood specimen.

In the blood collection instrument according to an eighth aspect, the case includes a pushing rod which is positioned on a side opposite to the opening and which slides toward the opening side.

A blood test kit according to a ninth aspect comprises the above-described blood collection instrument which is for collecting a blood specimen; a dilute solution for diluting the collected blood specimen; and an accommodation instrument for accommodating a dilution of the blood specimen. A concentration of a target component in the blood specimen is analyzed using a standard component constantly present in blood or a standard component not present in blood but contained in the dilute solution.

In the blood test kit according to a tenth aspect, the blood test kit further comprises a separation instrument for separating and recovering plasma from the dilution of the blood specimen.

According to the present invention, a blood specimen can be easily released.

DESCRIPTION OF THE PREFERRED EMBODIMENTS

Figure 1:
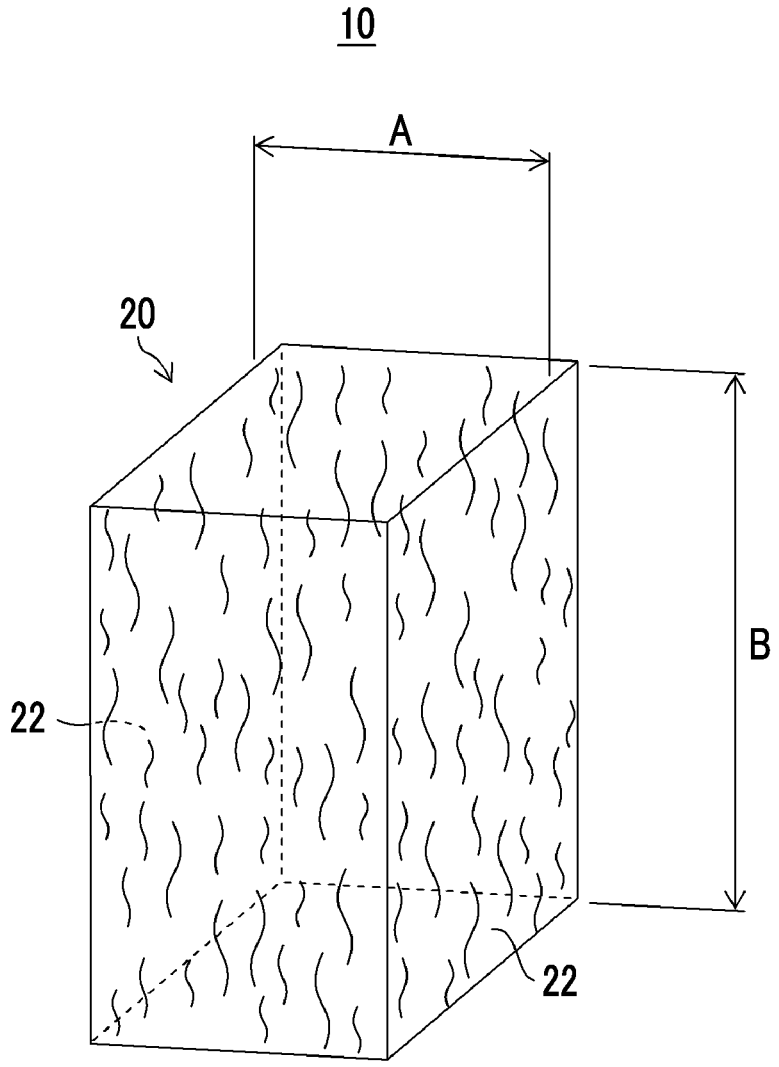
FIG. 1 is a perspective view of a fiber rod of a first embodiment.

Hereinafter, preferred embodiments of the present invention will be described with reference to attached drawings. The present invention will be explained by the following preferred embodiments. Modifications can be made by many methods without departing from the scope of the present invention and other embodiments besides the embodiments can be used. Accordingly, all modifications within the scope of the present invention are included in the scope of the claims. In the present specification, in a case where numerical ranges are expressed using "to," the numerical range also includes numerical values of an upper limit and a lower limit indicated by "to." A standard component constantly present in the blood may be referred to as an external standard substance or an external standard. In addition, a standard component not present in the blood may be referred to as an internal standard substance or an internal standard.

Fiber Rod

It is necessary to release a blood specimen collected inside a fiber rod into a dilute solution and the like, in blood collection using the fiber rod used for a blood collection instrument. In a case where the blood specimen cannot be sufficiently released from the inside of the fiber rod, an amount of blood collected is insufficient, resulting in a deterioration of test accuracy.

The inventors of the present invention have made an extensive investigation on a fiber rod structure that allows the collected blood specimen to be released from the inside of the fiber rod. As a result, the inventors of the present invention have found that a distance from a certain position inside the fiber rod to an outermost surface is important, and therefore have completed the present invention.

The fiber rod of the embodiment includes a fiber portion which is composed of a first fiber and a second fiber having different fiber diameters and which has a void volume within a range of 90% to 97%, in which a distance between surfaces facing each other of the fiber portion includes a region within a range of 1 mm to 1.6 mm.

The fiber portion of the fiber rod is composed of the first fiber and the second fiber which have different fiber diameters. For example, in a case where the fiber portion of the fiber rod is composed of only one type of fiber having a small fiber diameter, separation of the blood specimen of the fiber rod, that is, a release performance deteriorates. On the other hand, in a case where the fiber portion of the fiber rod is composed of only one type of fiber having a large fiber diameter, an absorption performance of the blood specimen of the fiber rod deteriorates.

By adding fibers having a small fiber diameter and fibers having a large fiber diameter to configure the fiber portion of the fiber rod with two types of fibers having different fiber diameters (the first fiber and the second fiber), the release performance and the absorption performance of the blood specimen can be improved. It is perceived that, due to the fiber having a large fiber diameter, a space between fibers becomes large, a contact area between the fiber and the blood specimen becomes small, and therefore the release performance is improved. In addition, it is also perceived that a contact area with the blood specimen is increased by the fiber having a small fiber diameter, and therefore the absorption performance is improved.

The first fiber having a small fiber diameter preferably has a fiber diameter of 14 μm to 21 μm, and more preferably has a fiber diameter of 16 μm to 20 μm. In addition, the second fiber having a large fiber diameter preferably has a fiber diameter of 22 μm to 29 μm, and more preferably has a fiber diameter of 24 μm to 27 μm. The fiber diameters of the first fiber and the second fiber can be checked by an electron microscope.

The fiber portion has a void volume within a range of 90% to 97%. By setting the void volume within the range of 90% to 97%, the fiber portion can increase an absorbed amount of the blood specimen per volume and can have mechanical strength capable of maintaining the morphology thereof.

The void volume of the fiber portion can be obtained as follows. A weight of each of the first fiber and the second fiber constituting the fiber portion is measured. A volume of each of the first fiber and the second fiber is obtained from a density of each of the first fiber and the second fiber and a weight of each of the first fiber and the second fiber. This is used as a calculated volume. A volume is obtained from an actual size of the fiber portion of the fiber rod. This is used as an actual volume. A void volume can be obtained by the following formula.

$$\text{Void volume}=(1-\text{calculated volume}/\text{actual volume})\times 100(\%)$$

As a material constituting the first fiber and the second fiber, it is preferable to use a synthetic fiber, and more preferably a polyester fiber. In a case of using polyester fibers, a shape of fibers can be easily changed.

A distance between surfaces facing each other of the fiber portion of the fiber rod of the embodiment includes a region within a range of 1 mm to 1.6 mm. In the region within the range of 1 mm to 1.6 mm, it is possible to easily release the blood specimen absorbed inside the fiber portion to the outside of the fiber portion.

With reference to FIG. 1 to FIG. 5, preferred shapes of the fiber rod will be described. A fiber rod 10 shown in FIG. 1 comprises a fiber portion 20 in a form of a quadrangular prism. A distance A between surfaces facing each other of the fiber portion 20 includes a region within the range of 1 mm to 1.6 mm. In the fiber portion 20, the distance A of all surfaces facing each other need not be within the range of 1 mm to 1.6 mm. For example, even in a case where a distance B between surfaces facing each other of the fiber portion exceeds the range of 1 mm to 1.6 mm, it is possible to easily release the blood specimen absorbed inside the fiber portion 20 from surfaces 22 facing each other.

Figure 2:
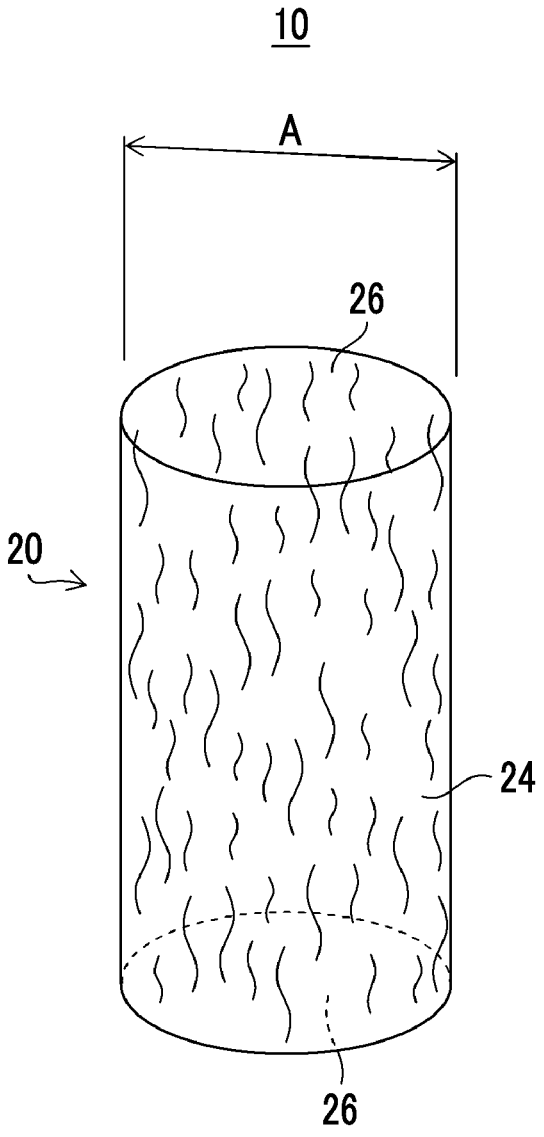
FIG. 2 is a perspective view of a fiber rod of a second embodiment.

A fiber rod 10 shown in FIG. 2 comprises a cylindrical fiber portion 20. A distance A between surfaces facing each other of the fiber portion 20 includes a region within the range of 1 mm to 1.6 mm. In the cylindrical fiber portion 20, the distance A is a diameter of a bottom surface. Surfaces facing each other means a side surface 24 in the cylindrical fiber portion 20. A distance between bottom surfaces 26 may exceed the range of 1 mm to 1.6 mm. The blood specimen absorbed inside the fiber portion 20 can be easily released from the side surface 24 of the fiber portion 20. The cylindrical fiber portion 20 can be absorbed to and released isotropically from the side surface 24, and thus is preferable.

Figure 3:
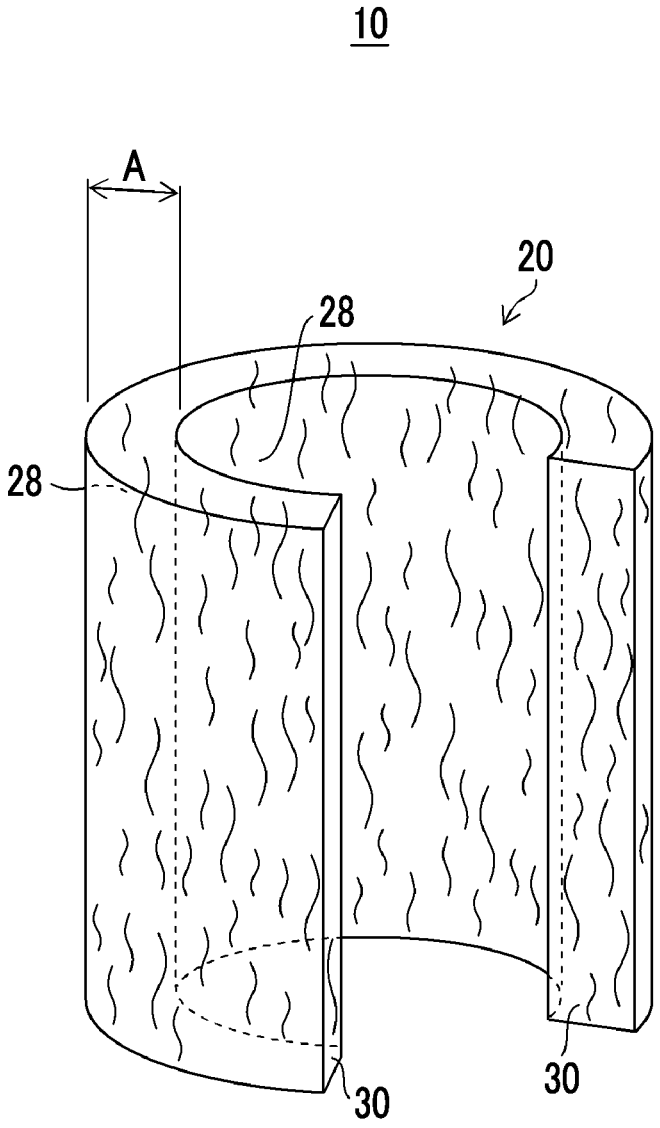
FIG. 3 is a perspective view of a fiber rod of a third embodiment.

A fiber rod 10 shown in FIG. 3 comprises a fiber portion 20 having a C-shaped cross section. A distance A between surfaces facing each other of the fiber portion 20 includes a region within the range of 1 mm to 1.6 mm. A C shape is a shape in which a part of a circular ring is cut out in a cross-sectional view. In a broad sense, a shape includes a J shape, a V shape, and an L shape, and refers to a shape in which the fiber portion 20 is not a straight line in a cross-sectional view, and end surfaces 30 of the fiber portion 20 are not connected to each other. Blood specimens absorbed inside the fiber portion 20 can be easily released from surfaces 28 facing each other of the fiber portion 20.

Figure 4:
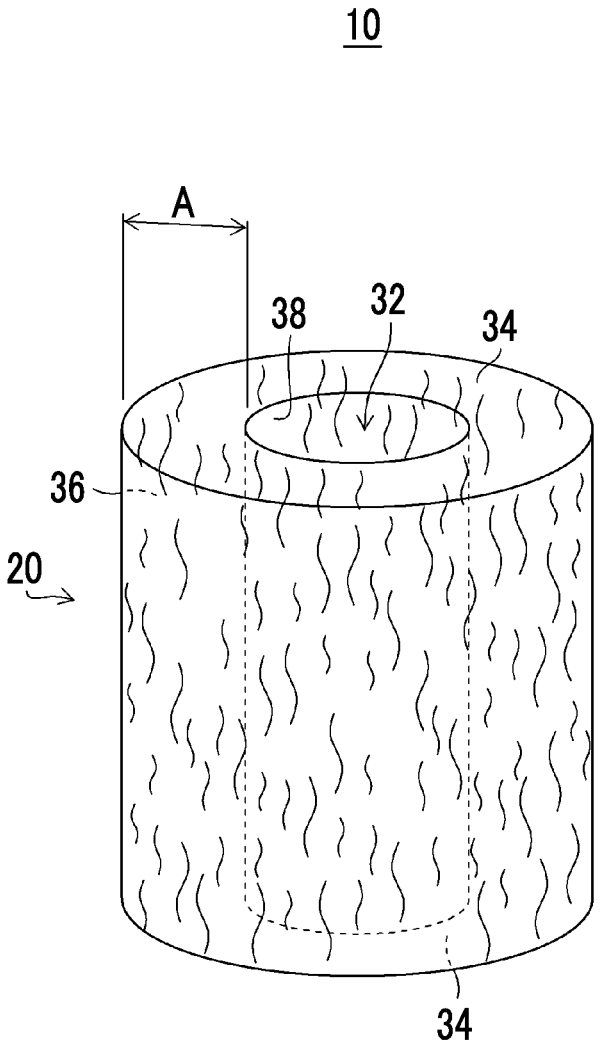
FIG. 4 is a perspective view of a fiber rod of a fourth embodiment.

A fiber rod 10 shown in FIG. 4 comprises a fiber portion 20. The fiber portion 20 has a cylindrical shape as a whole and has an annular hollow structure defining a space 32 therein in a cross-sectional view. The space 32 means a region not having the fiber portion 20. As shown in FIG. 4, the space 32 has an opening in two bottom surface faces 34 of the fiber portion 20, thereby constituting a through-hole. A distance between surfaces facing each other of the fiber portion 20 includes a region within the range of 1 mm to 1.6 mm. The distance A between surfaces facing each other of the annular fiber portion 20 is a distance between an outer surface 36 and an inner surface 38. In the fiber rod 10 shown in FIG. 4, a blood specimen is absorbed from the outer surface 36 and from the inner surface 38 of the space 32 into the fiber portion 20. In addition, the blood specimen absorbed in the fiber portion 20 is released from the outer surface 36 to the outside and from the inner surface 38 to the space 32.

A ratio (V1/V2) of a volume (V1) of the space 32 to a volume (V2) of the fiber portion 20 is preferably within a range of 0.4 to 1.0. By setting a volume ratio of the space 32 and the fiber portion 20 within the above range, a shape of the fiber rod 10 can be maintained, and absorption and release of the blood specimen to and from the fiber portion 20 can be easily performed.

Because the fiber portion 20 has a cylindrical shape as a whole and the space 32 defined inside the fiber portion 20 also has a cylindrical shape, it is possible to isotropically absorb and release the blood specimen, and therefore manufacture of the fiber rod 10 becomes easy. However, an overall shape of the fiber portion 20 and a shape of the space 32 are not limited to the cylindrical shape. In addition, the space 32 may have a shape having an opening only on one bottom surface 34.

Figure 5:
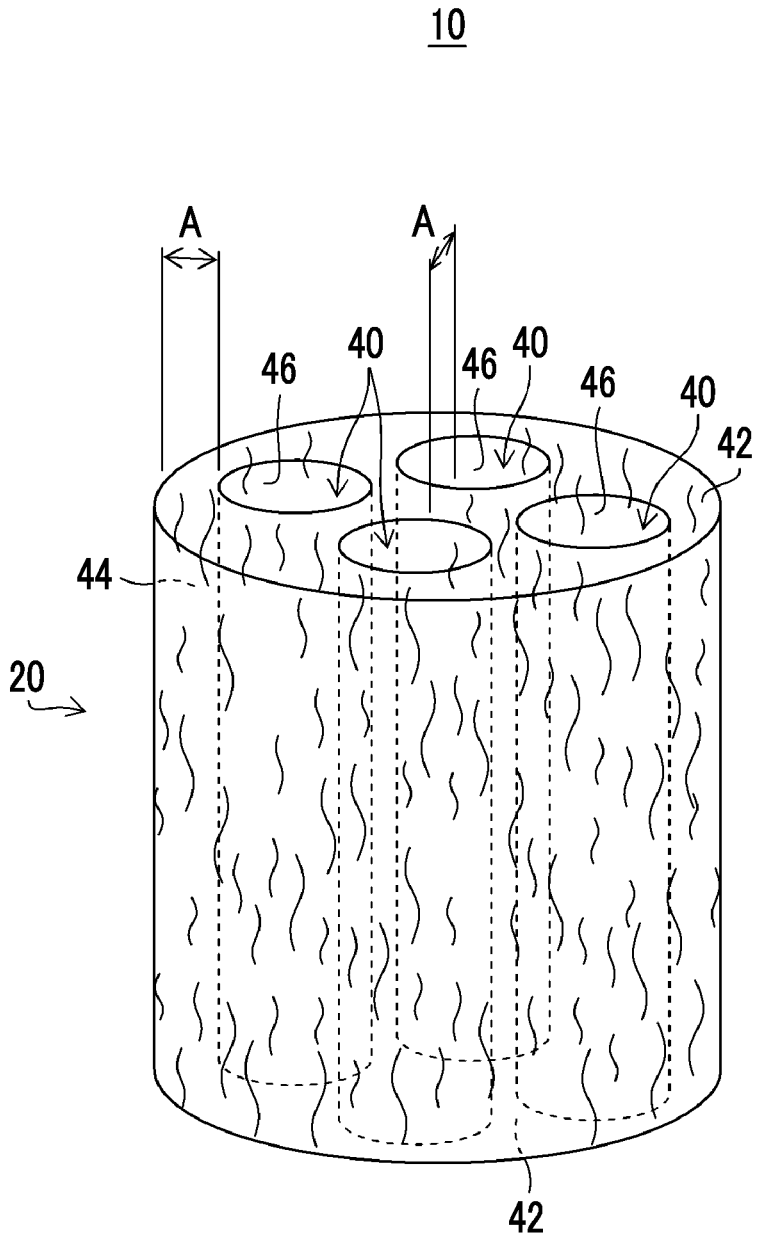
FIG. 5 is a perspective view of a fiber rod of a fifth embodiment.

A fiber rod 10 shown in FIG. 5 comprises a fiber portion 20. The fiber portion 20 has a cylindrical shape as a whole and has a hollow structure defining a plurality of spaces 40 inside the fiber portion 20. Each of the plurality of spaces 40 has an opening in each of the two bottom surfaces 42 of the fiber portion 20, thereby constituting a plurality of through-holes. A distance A between surfaces facing each other of the fiber portion 20 includes a region within the range of 1 mm to 1.65 mm. The distance A between surfaces facing each other of the fiber portions 20 of the hollow structure defining the plurality of spaces 40 is a distance between an outer surface 44 and an inner surface 46, and a distance between the inner surface 46 and the inner surface 46. In the fiber rod 10 shown in FIG. 5, a blood specimen is absorbed from the outer surface 44 and from the inner surface 46 of the plurality of spaces 40 into the fiber portion 20. In addition, the blood specimen absorbed in the fiber portion 20 is released from the outer surface 44 to the outside and from the inner surface 46 to the space 40. Because the plurality of spaces 40 are defined in the fiber portion 20, a plurality of inner surfaces 46 are formed. As a result, a contact area between the fiber portion 20 and the outside is increased, and therefore it becomes easy to absorb and release the blood specimen with respect to the fiber portion 20.

A ratio (V1/V2) of a volume (V1) of the space 40 to a volume (V2) of the fiber portion 20 is preferably within a range of 0.4 to 1.0. By setting a volume ratio of the space 40 and the fiber portion 20 within the above range, a shape of the fiber rod 10 can be maintained, and absorption and release of the blood specimen to and from the fiber portion 20 can be easily performed.

An overall shape of the fiber portion 20 and a shape of the space 40 are not limited to the cylindrical shape. In addition, the space 40 may have a shape having an opening only on one bottom surface 42.

Blood Collection Instrument

Next, with reference to FIG. 6 to FIG. 9, a blood collection instrument will be described. As shown in the exploded view of FIG. 6, a blood collection instrument 100 comprises a case 110 in which an opening 112 is defined on one side, and a fiber rod 10 attachably and detachably held on the side of the opening 112. In the embodiment, an example in which the fiber rod 10 shown in FIG. 4 is applied will be described. The fiber rod 10 comprises a fiber portion 20 having a hollow structure defining a space 32.

The case 110 comprises a distal end accommodation portion 114 for accommodating the fiber rod 10 on the other side from the side of the opening 112, a central portion 116, a flange portion 118, and a base end accommodation portion 120 in which an opening 122 is defined. The case 110 is an integral molding, and the opening 112 and the opening 122 pass through therethrough.

Figure 6:
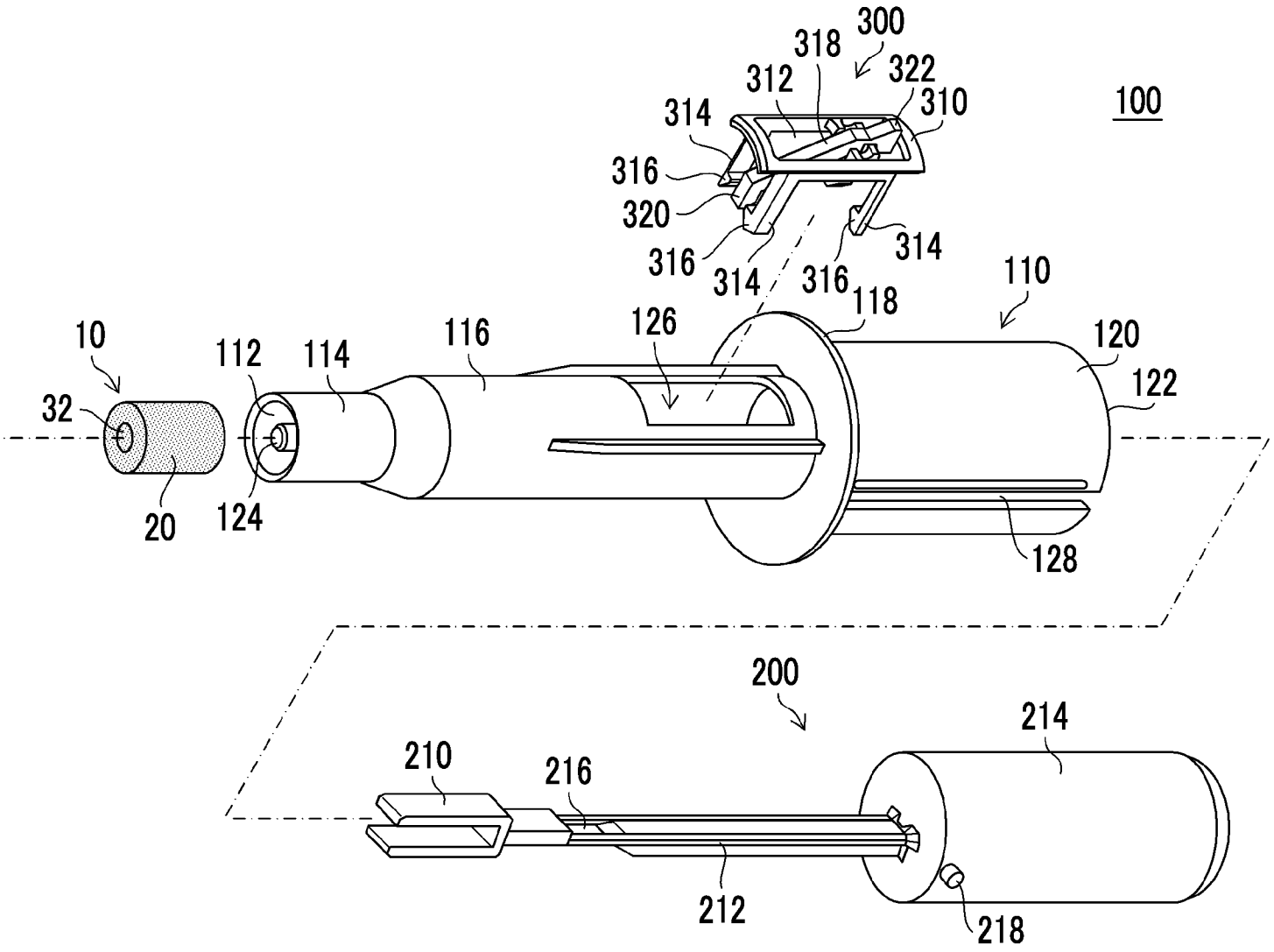
FIG. 6 is an exploded perspective view showing an example of a blood collection instrument.

As shown in FIG. 6, the fiber rod 10 is attachably and detachably held in the distal end accommodation portion 114. The distal end accommodation portion 114 comprises a member 124 which is inserted into the space 32 of the fiber rod 10. The distal end accommodation portion 114 has a substantially cylindrical shape, and an inner diameter of the distal end accommodation portion 114 and an outer diameter of the fiber rod 10 are substantially the same size. The member 124 is formed along an axial direction of the case 110. The phrase, along the axial direction, means parallel or substantially parallel to the axial direction.

A central portion 116 has a larger diameter than that of the distal end accommodation portion 114 and has a substantially cylindrical shape. An opening 126 for fitting a locking lever 300 which will be described later is formed in the central portion 116. A person collecting blood can hold the blood collection instrument 100 by grasping the flange portion 118 between the central portion 116 and the base end accommodation portion 120 with fingers.

The base end accommodation portion 120 has a larger diameter than that of the central portion 116 and has substantially cylindrical shape. A slide groove 128 is formed in the base end accommodation portion 120 along the axial direction of the blood collection instrument 100.

A pushing rod 200 is positioned on the side opposite to the opening 112 and comprises a U-shaped pushing member 210, an operation portion 214, and a connecting member 212 connecting the pushing member 210 and the operation portion 214. An opening 216 for engaging with the locking lever 300 is formed in the connecting member 212. The operation portion 214 has a substantially cylindrical shape, and the operation portion 214 is accommodated in the base end accommodation portion 120.

A protrusion 218 is formed on an outer peripheral surface of the operation portion 214. The protrusion 218 is inserted into the slide groove 128 of the base end accommodation portion 120. The protrusion 218 can move along the slide groove 128. By inserting the protrusion 218 into the slide groove 128, rotation of the pushing rod 200 around the axial direction is restricted.

The locking lever 300 comprises a rectangular frame 310 in which an opening 312 is formed, and four legs 314 in a direction perpendicular to the frame 310. Each of engaging claws 316 is formed on a distal end side of the leg portion 314. A lever 318 extending in a direction of the leg portion 314 is supported pivotally on the frame 310. A lever claw portion 320 engaging with the opening 216 of the connecting member 212 is provided at a distal end of the lever 318. A lever operation portion 322 is provided at a base end of the lever 318. In a case where the lever operation portion 322 is moved in a direction of the leg portion 314, the lever 318 moves rotationally about a support shaft. The lever claw portion 320 moves in a direction of the frame 310 and engagement between the opening 216 and the lever claw portion 320 is released.

The case 110, the pushing rod 200, and the locking lever 300 are made of, for example, polypropylene.

Figure 7:
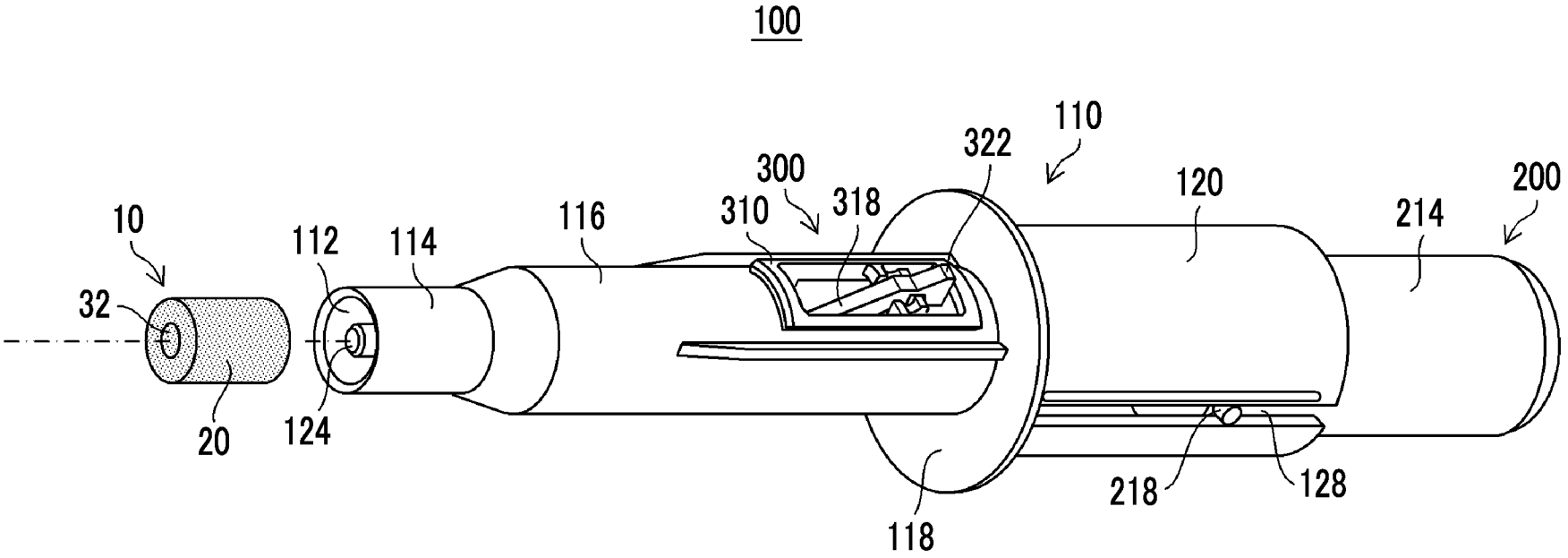
FIG. 7 is an assembly view of the blood collection instrument.

FIG. 7 is a perspective view in which the case 110, the pushing rod 200, and the locking lever 300 are assembled except for the fiber rod 10. As shown in FIG. 7, the operation portion 214 of the pushing rod 200 is accommodated in the base end accommodation portion 120 of the case 110. In addition, the protrusion 218 of the pushing rod 200 is inserted into the slide groove 128 of the base end accommodation portion 120. The locking lever 300 is attached to the opening 126 (not shown) of the case 110, and the lever claw portion 320 (not shown) of the lever 318 is engaged with the opening 216 (not shown) of the pushing rod 200. The movement of the pushing rod 200 in the axial direction is restricted.

Figure 8:
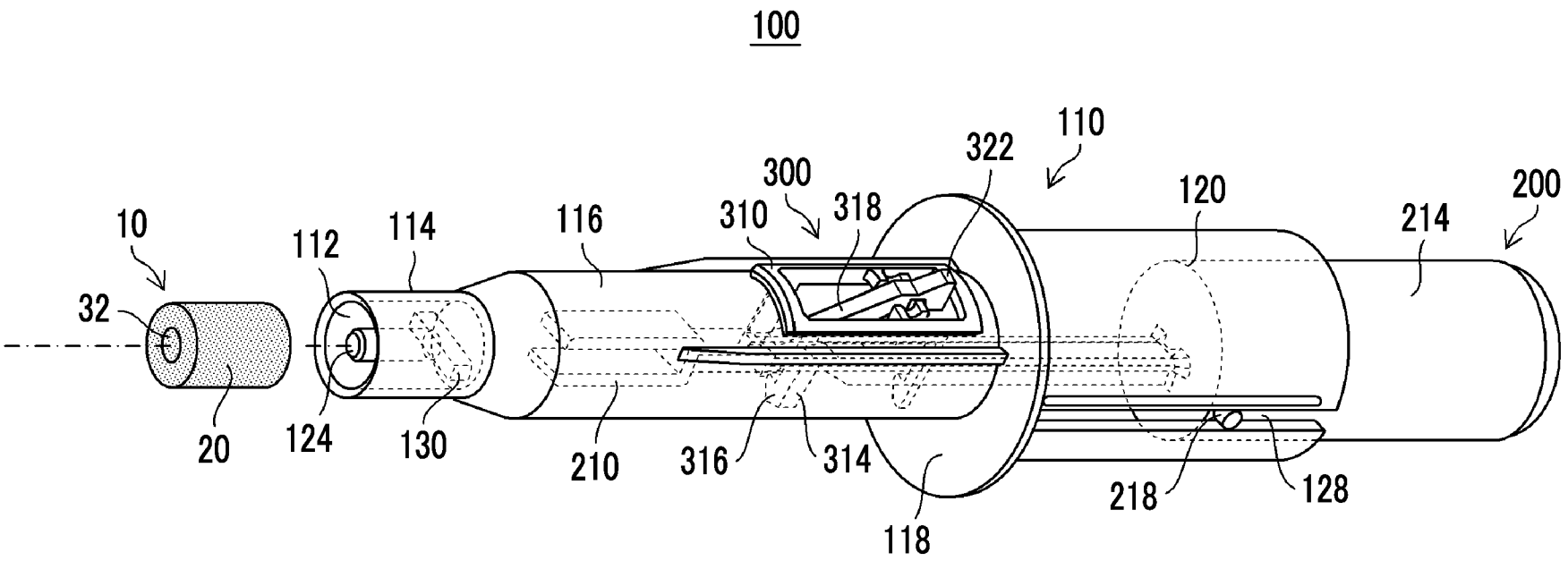
FIG. 8 is a transmissive view of the assembly view of the blood collection instrument in FIG. 7.

FIG. 8 is a transmissive view of FIG. 7. As shown in FIG. 8, a beam member 130 that supports a member 124 is provided in the distal end accommodation portion 114. The beam member 130 is perpendicular to the axial direction. A gap defined by the beam member 130 and the distal end accommodation portion 114 allows the U-shaped pushing member 210 to pass through. The connecting member 212 is engaged by the engaging claw 316 of the leg portion 314.

Figure 9:
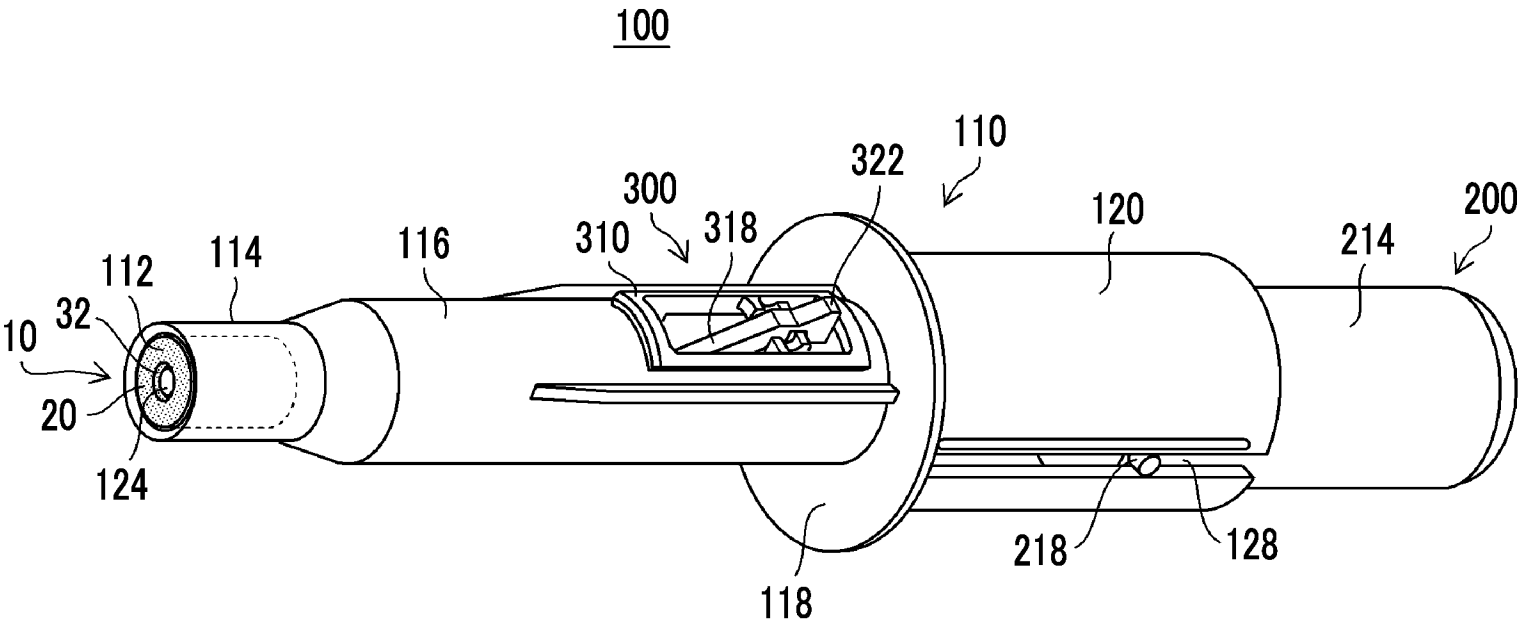
FIG. 9 is an assembly view of the blood collection instrument.

FIG. 9 is a perspective view in which the fiber rod 10, the case 110, the pushing rod 200, and the locking lever 300 are assembled. In FIG. 9, in order to facilitate understanding of the blood collection instrument 100, reference numerals are omitted. The fiber rod 10 is attachably and detachably held in the distal end accommodation portion 114 on the side of the opening 112 of the case 110. The member 124 is inserted into the space 32 defined in the fiber portion 20. It is preferable that the distal end accommodation portion 114 of the case 110 constituting the blood collection instrument 100 be transparent. It is possible to check an amount of blood specimen absorbed by the fiber rod 10 through the distal end accommodation portion 114.

Because the blood collection instrument 100 comprises the pushing rod 200, after the blood specimen is collected, the fiber rod 10 can be easily pushed out of the case 110.

A blood collection method by the above-described blood collection instrument 100 will be described. Collection of the blood specimen may be performed by a subject himself or by a qualified person such as a doctor. In a preferred embodiment, the fiber rod 10 held by the case 110 of the blood collection instrument 100 is brought into contact with a blood specimen which leaks outside the skin by damaging a fingertip or the like by a subject himself or herself using a knife-equipped instrument such as a lancet. The fiber portion 20 of the fiber rod 10 has a void volume of 90% to 97%. Because the blood specimen is absorbed in a space of the fiber portion 20, the blood specimen can be collected in the fiber rod 10. At the time when it is confirmed that the fiber rod 10 becomes red in its entirety, collection of the blood specimen is completed.

Figure 10:
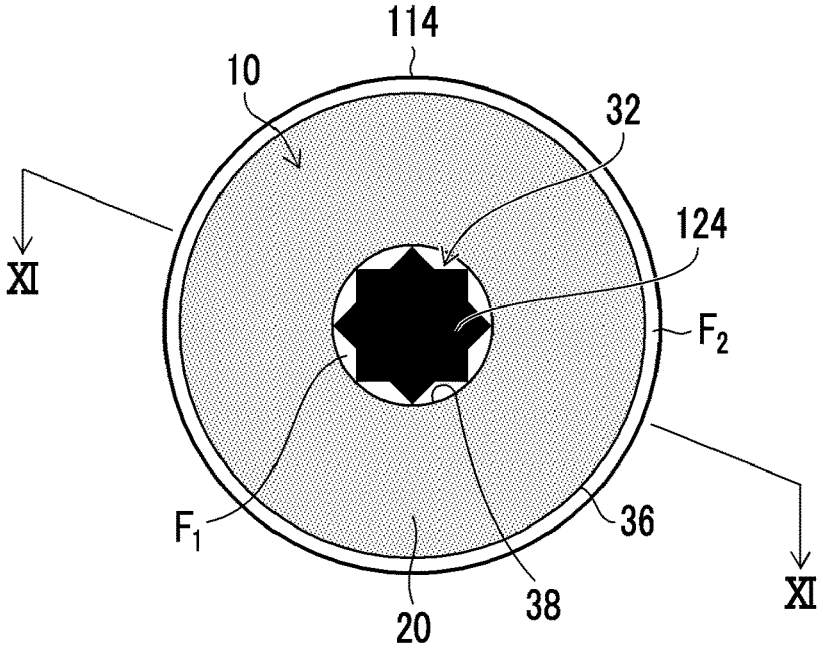
FIG. 10 is a cross-sectional view in a direction orthogonal to an axial direction of the fiber rod of the fourth embodiment, which is accommodated in a distal end accommodation portion.
Figure 11:
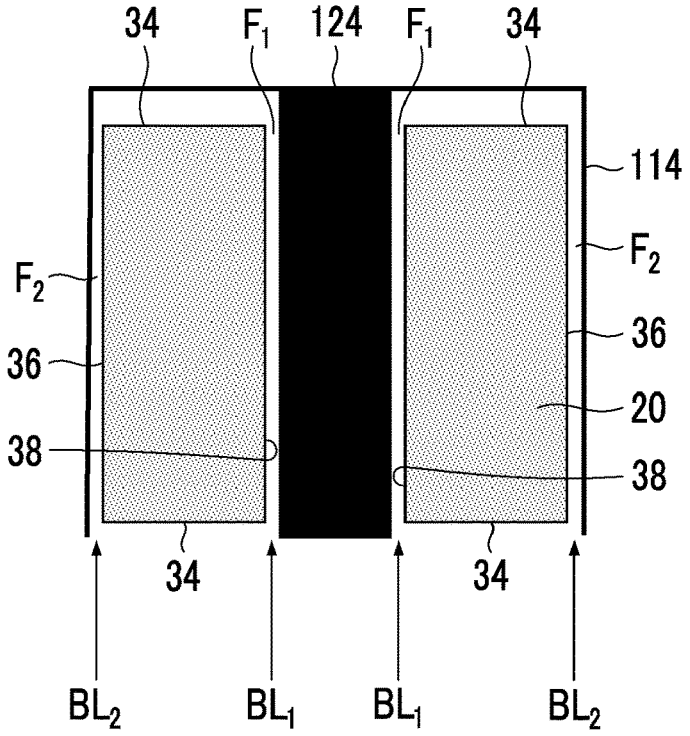
FIG. 11 is a cross-sectional view in a direction parallel to the axial direction of the fiber rod of the fourth embodiment, which is accommodated in the distal end accommodation portion.

Next, another embodiment of the fiber rod 10 and the member 124 will be described with reference to FIGS. 10 to 13. FIG. 10 is a cross-sectional view of the distal end accommodation portion 114 in a direction orthogonal to the axial direction, and FIG. 11 is a cross-sectional view of the distal end accommodation portion 114 in a direction parallel to the axial direction. As shown in FIG. 10, the fiber rod 10 is the fiber rod of the fourth embodiment. The member 124 formed in the distal end accommodation portion 114 has a star-shaped octagonal shape in a cross-sectional view. In a case where the member 124 is inserted into the space 32 of the fiber rod 10, a region where the member 124 and the inner surface 38 do not come into contact with each other is formed. As a result, as shown in FIG. 11, the member 124 and the fiber rod 10 form the flow path $F_1$ of the blood specimen. By forming the flow path $F_1$, it is possible to cause a capillary phenomenon to act between the member 124 and the fiber rod 10. The blood specimen can be drawn up along the inner surface 38 of the fiber portion 20 from a direction indicated by an arrow $BL_1$ in FIG. 11, and the blood specimen can also be absorbed from the inner surface 38 into the fiber portion 20. In addition, a region where the member 124 and the inner surface 38 come into contact with each other includes a function of holding the fiber rod 10 in the distal end accommodation portion 114.

As shown in FIG. 10 and FIG. 11, by making an outer diameter of the fiber rod 10 smaller than an inner diameter of the distal end accommodation portion 114, the outer surface 36 of the fiber portion 20 can be spaced from the inner surface of the distal end accommodation portion 114. A flow path $F_2$ of the blood specimen is formed by the fiber rod 10 and the distal end accommodation portion 114. By forming the flow path $F_2$, it is possible to cause a capillary phenomenon to act between the distal end accommodation portion 114 and the fiber rod 10. The blood specimen can be drawn up along the outer surface 36 of the fiber portion 20 from a direction indicated by an arrow $BL_2$ in FIG. 11, and the blood specimen can also be absorbed from the outer surface 36 into the fiber portion 20.

Figure 12:
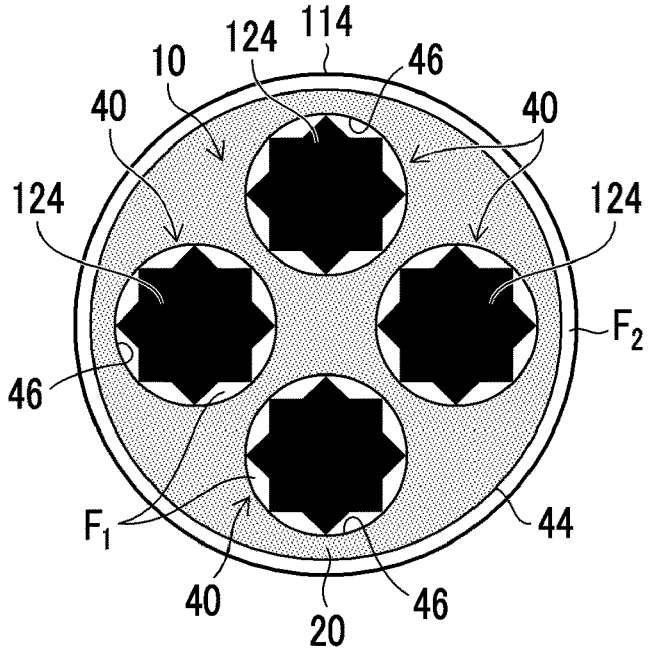
FIG. 12 is a cross-sectional view in a direction orthogonal to an axial direction of the fiber rod of the fifth embodiment, which is accommodated in the distal end accommodation portion.

FIG. 12 is a cross-sectional view of the distal end accommodation portion 114 in a direction orthogonal to the axial direction. As shown in FIG. 12, the fiber rod 10 is the fiber rod of the fifth embodiment, and a plurality of spaces 40 are defined in the fiber portion 20. Each of a plurality of members 124 formed in the distal end accommodation portion 114 has a star-shaped octagonal shape in a cross-sectional view. In a case where the member 124 is inserted into the space 40 of the fiber rod 10, a region where the member 124 and the inner surface 46 do not come into contact with each other is formed. As a result, the plurality of members 124 and the fiber rod 10 form the flow path $F_1$ of the blood specimen. By forming the flow path $F_1$, it is possible to cause a capillary phenomenon to act between the member 124 and the fiber rod 10. The blood specimen can be drawn up along the inner surface 46 of the fiber portion 20, and the blood specimen can also be absorbed from the inner surface 46 into the fiber portion 20. In addition, a region where the member 124 and the inner surface 46 come into contact with each other includes a function of holding the fiber rod 10 in the distal end accommodation portion 114.

As shown in FIG. 12, by making an outer diameter of the fiber rod 10 smaller than an inner diameter of the distal end accommodation portion 114, the outer surface 44 of the fiber portion 20 can be spaced from the inner surface of the distal end accommodation portion 114. A flow path $F_2$ of the blood specimen is formed by the fiber rod 10 and the distal end accommodation portion 114. By forming the flow path $F_2$, it is possible to cause a capillary phenomenon to act between the distal end accommodation portion 114 and the fiber rod 10. The blood specimen can be drawn up along the outer surface 44 of the fiber portion 20, and the blood specimen can also be absorbed from the outer surface 44 into the fiber portion 20.

Figure 13:
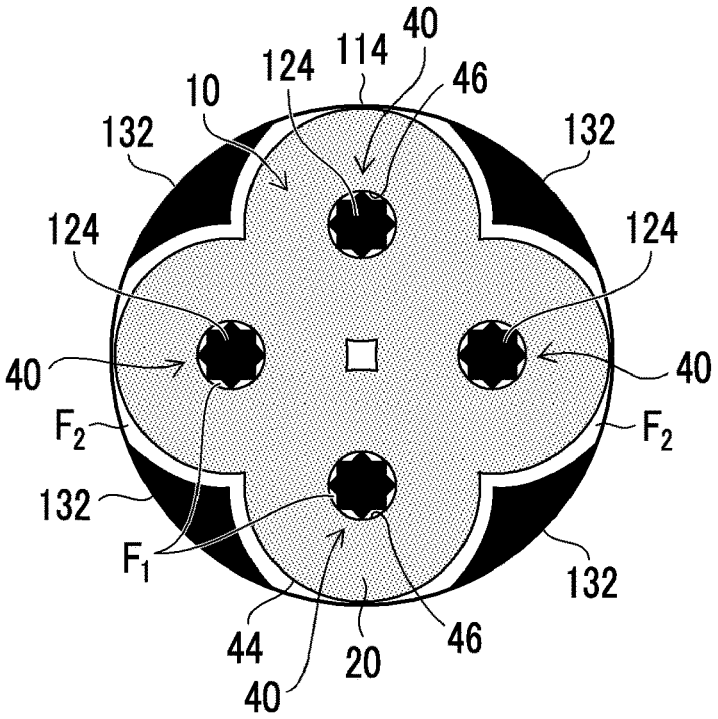
FIG. 13 is a cross-sectional view in a direction orthogonal to an axial direction of a fiber rod of a modification example of the fifth embodiment, which is accommodated in the distal end accommodation portion.

FIG. 13 is a cross-sectional view of the distal end accommodation portion 114 in a direction orthogonal to the axial direction. As shown in FIG. 12, the fiber rod 10 is a modification example of the fiber rod of the fifth embodiment. In the same manner as in the fifth embodiment, a plurality of spaces 40 are defined in the fiber portion 20. Meanwhile, unlike the fifth embodiment, the outer surface 44 of the fiber portion 20 is not a circle, and the outer surface 44 has a shape in which four semicircles are continuously connected. In the same manner as FIG. 12, the plurality of members 124 and the fiber rod 10 form the flow path $F_1$ of the blood specimen. Utilizing the capillary phenomenon, the blood specimen can be drawn up along the inner surface 48 of the fiber portion 20, and the blood specimen can also be absorbed from the inner surface 46 into the fiber portion 20.

Meanwhile, in FIG. 13, in order to form the flow path $F_2$ of a liquid specimen by the outer surface 44 of the fiber portion 20 and the distal end accommodation portion 114, a plurality of members 132 are formed on the inner surface of the distal end accommodation portion 114. By forming the member 132, a capillary phenomenon can be exerted between the outer surface 44 and the member 132. Accordingly, the blood specimen can also be absorbed from the outer surface 44 of the fiber portion 20.

Blood Test Kit

A blood test kit comprises the above-described blood collection instrument 100; a dilute solution for diluting the collected blood specimen; and an accommodation instrument for accommodating a dilution of the blood specimen. The blood test kit is for analyzing a concentration of a target component in the blood specimen using a standard component constantly present in blood or a standard component not present in blood, which is a standard component contained in the dilute solution.

Furthermore, the blood test kit preferably comprises a separation instrument for separating and recovering plasma from the dilution of the blood specimen.

Accommodation Instrument

Figure 14:
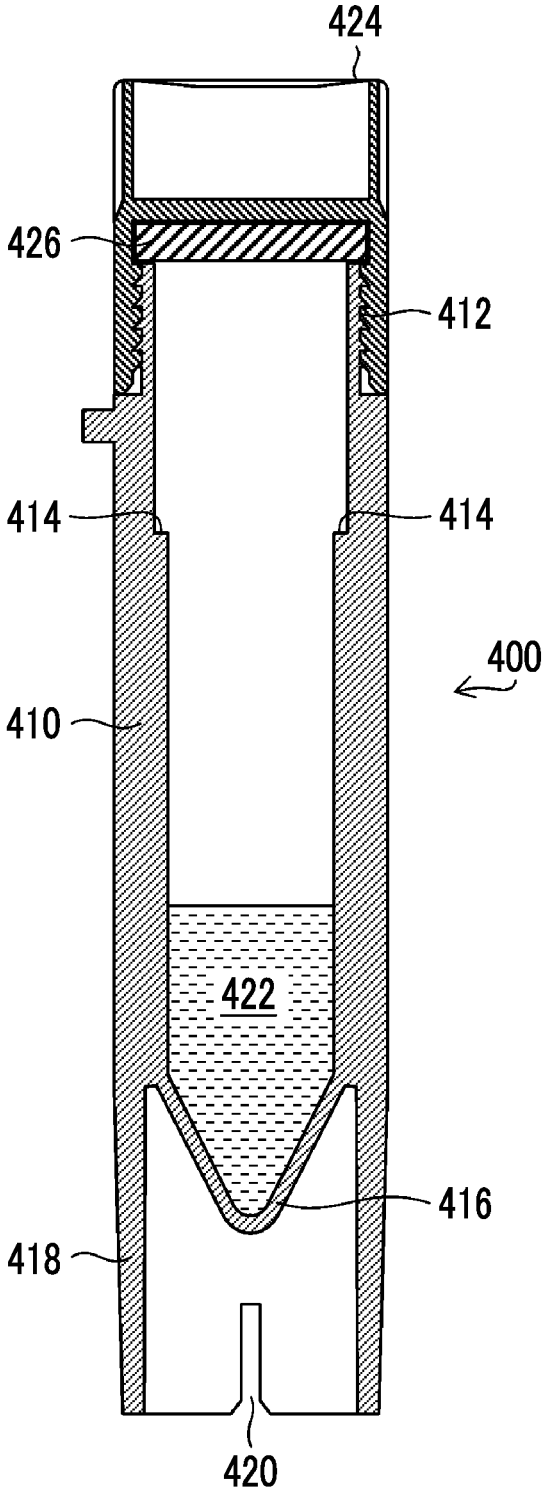
FIG. 14 is a view showing an example of a configuration of an accommodation instrument for accommodating a dilution of a blood specimen.

FIG. 14 is a cross-sectional view showing an example of a configuration of an accommodation instrument for accommodating a dilution of a blood specimen. As shown in FIG. 14, an accommodation instrument 400 has a cylindrical blood collection container 410 of a transparent material. On an upper end side of the blood collection container 410, a screw portion 412 is formed on the outer surface, and an engaging portion 414 is protruded on the inner surface. In addition, a conical bottom portion 416 protruding toward a lower end side is formed at a lower end portion of the blood collection container 410. A cylindrical leg portion 418 is formed around the bottom portion 416. The term "upper" and "lower" mean "upper" and "lower" in a state in which the leg portion 418 is placed on the placement surface.

The leg portion 418 has the same outer diameter as that of a sample cup (not shown) used when performing an analytical test of blood, and each of slit grooves 420 is formed in a vertical direction at positions facing, preferably a lower end thereof. In addition, as shown in FIG. 14, it is preferable that a required amount, for example, 500 $mm^3$ of a dilute solution 422 be accommodated in the blood collection container 410.

As shown in FIG. 14, it is preferable that an upper end opening of the blood collection container 410 be hermetically sealed with a cap 424 via a packing 426 before using the accommodation instrument 400.

Standard Component Constantly Present in Blood

For accurate analysis of a concentration present in plasma of the blood before dilution with respect to a target component after dilution of diluted plasma, in which a dilution factor of plasma components is high, it is possible to employ a method of obtaining from a rate of change in concentration of a substance preliminarily present in the dilute solution. In addition, it is also possible to employ a method for analyzing a concentration of a target component in a blood specimen using a standard component constantly present in the blood. In a case of analyzing blood components from a smaller amount of blood, a case of employing a method using a standard component constantly present in the blood is preferable, because it is possible to perform measurement with a small measurement error. Accordingly, as the blood test kit of the embodiment of the present invention, the blood test kit for analyzing a concentration of a target component in a blood specimen using a standard component constantly present in the blood is one of preferred embodiments.

Here, the term "using" a standard component means to determine a dilution factor for analyzing a concentration of a target component based on a standard value for a standard component (a constant value in a case of using the standard component constantly present in the blood). Accordingly, a case of analyzing a concentration of a target component in a blood specimen using a standard component constantly present in the blood, also means that a dilution factor is determined based on a constant value (standard value) of the standard component constantly present in the blood, and that a concentration of a target component is analyzed.

Examples of the standard component constantly present in the blood include sodium ion, chloride ion, potassium ion, magnesium ion, calcium ion, total protein, albumin, and the like. Concentrations of these standard components contained in serum and plasma of a blood specimen are as follows: a concentration of sodium ion is 134 mmol/L to 146 mmol/L (average value: 142 mmol/L), a concentration of chloride ion is 97 mmol/L to 107 mmol/L (average value: 102 mmol/L), a concentration of potassium ion is 3.2 mmol/L to 4.8 mmol/L (average value: 4.0 mmol/L), a concentration of magnesium ion is 0.75 mmol/L to 1.0 mmol/L (average value: 0.9 mmol/L), a concentration of calcium ion is 4.2 mmol/L to 5.1 mmol/L (average value: 4.65 mmol/L), a concentration of total protein is 6.7 g/100 ml to 8.3 g/100 ml (average value: 7.5 g/100 mL), a concentration of albumin is 4.1 g/100 mL to 5.1 g/100 mL (average value: 4.6 g/100 mL). The embodiment is for making it possible to measure a target component in a case where an amount of blood to be collected is extremely small to ease the pain of a subject, and therefore, in a case of diluting a small amount of blood in a dilute solution, it is necessary to accurately measure a concentration of the "standard component constantly present in the blood," which is present in the dilute solution. In a case where a dilution factor increases, a concentration of components originally present in the blood in the dilute solution decreases, and therefore, depending on a dilution factor, there is a possibility of including a measurement error when measuring a concentration. Therefore, in order to sufficiently and precisely detect the standard component in a case where a small amount of blood components is diluted by a high dilution factor, it is preferable to measure the standard component present in a small amount of blood at a high concentration. In the present invention, it is preferable to use sodium ion ($Na^+$) or chloride ion ($Cl^-$) present at a high concentration among components constantly present in the blood specimen. Furthermore, it is most preferable to measure sodium ions having the highest amount present in the blood among the above-mentioned standard components constantly present in the blood. For sodium ions, an average value represents a standard value (a median value within a reference range), and this value is 142 mmol/L and occupies 90 mol % or more of total cations in the plasma.

Standard Component not Present in Blood

One of preferred aspects of the embodiment is a blood test kit for analyzing a concentration of a target component in a blood specimen using a standard component not present in the blood. Such a blood test kit may be a kit for using a standard component not present in the blood, together with a standard component constantly present in the blood, or may be a kit for using only a standard component not present in the blood without using a standard component constantly present in the blood.

In any case, the standard component not present in the blood can be used by being added to a dilute solution to be described later such that a concentration becomes a predetermined concentration. As a standard component not present in the blood, it is possible to use a substance which is not contained in the blood specimen at all or which is contained by an extremely small amount. As a standard component not present in the blood, it is preferable to use a substance that does not interfere with the measurement of a target component in the blood specimen, a substance that does not decompose under the action of a biological enzyme in the blood specimen, a substance that is stable during dilution, a substance that does not permeate the blood cell membrane, and thus is not contained in the blood cell, a substance that does not adsorb to a storage container of a buffer solution, and a substance for which a detection system performing measurement with high accuracy can be used.

A standard component not present in the blood is preferably a substance that is stable even in a state of being added to and stored in a dilute solution for a long period of time. Examples of standard components not present in the blood include glycerol triphosphate, Li, Rb, Cs, or Fr as alkali metals, and Sr, Ba, or Ra as alkaline earth metals, among which Li and glycerol triphosphate are preferred.

These standard components not present in the blood can be color-developed by adding a second reagent when measuring a concentration after blood dilution, and a concentration in the diluted blood can be obtained from a color density. For example, regarding the measurement of lithium ions added to the dilute solution, a large amount of sample can be easily measured with a small amount of sample with an automatic biochemistry analyzer by using a chelate colorimetric method (halogenated porphyrin chelating method: perfluoro-5,10,15,20-tetraphenyl-21H,23H-porphyrin). In addition, regarding the measurement of glycerol triphosphate, a large amount of sample can be easily measured with a small amount of sample with an automatic biochemistry analyze by using, for example, concentration measurement of color development of a coloring agent by oxidation condensation, which is described in "Home medical revolution" (clinical examination Vol. 59, p. 397, 2015), which is a known document.

Dilute Solution

The blood test kit contains a dilute solution to dilute the collected blood specimen. In a case where the blood test kit is for analyzing a concentration of a target component in the blood specimen using the standard component constantly present in the blood, the dilute solution does not contain a standard component constantly present in the blood. The phrase "not containing" means "substantially not containing." Here, the phrase "substantially not containing" means that any homeostatic substance to be used for obtaining a dilution factor is not used at all, or even in a case where the substance is contained, the substance is contained to the extent that a concentration of a small amount does not affect the measurement of a homeostatic substance in the dilute solution after diluting the blood specimen. In a case where sodium ions or chloride ions are used as a standard component constantly present in the blood, a dilute solution substantially not containing sodium ions or chloride ions is used as a dilute solution.

A pH of the blood is kept constant from a normal pH of 7.30 to a pH of about 7.40 in healthy subjects. Therefore, in order to prevent decomposition or denaturation of the target component, the dilute solution is preferably a buffer solution having a buffering action in a pH region within an range of pH 6.5 to pH 8.0, preferably within a range of pH 7.0 to pH 7.5, and more preferably within a range of pH 7.3 to pH 7.4; and the dilute solution is preferably a buffer solution containing a buffer component that suppresses variations in pH.

In the related art, as the type of a buffer solution, an acetate buffer solution (Na), a phosphate buffer solution (Na), a citrate buffer solution (Na), a borate buffer solution (Na), a tartrate buffer solution (Na), a tris(hydroxymethyl) aminoethane (Tris) buffer solution (Cl), a [2-[4-(2-hydroxyethyl)-1-piperazinyl]ethanesulfonic acid] (Hepes) buffer solution, and a phosphate buffered saline (Na) are known. Among them, as a buffer solution in the vicinity of pH 7.0 to pH 8.0, a phosphate buffer solution, a Tris buffer solution, and a Hepes buffer solution are representative. However, there are conditions that, because a phosphate buffer solution contains a sodium salt of phosphoric acid and a Tris buffer solution has a dissociation pKa of 8.08, in order to impart buffering ability in the vicinity of pH 7.0 to pH 8.0, the buffer solution is generally used in combination with hydrochloric acid; and that a pKa of dissociation of sulfonic acid of Hepes is 7.55, but in order to adjust the buffer solution with constant ionic strength, a mixture of sodium hydroxide, sodium chloride, and HEPES is generally used. When seen from these conditions, these buffer solutions are useful as a buffer solution having an action of keeping a pH constant.

However, these buffer solutions contain sodium ions or chloride ions which are substance preferably used as an external standard substance in the embodiment, and therefore application thereof is not preferable in a case where the blood test kit is for analyzing a concentration of a target component in the blood specimen using the standard component constantly present in the blood.

In a case where the blood test kit is for analyzing a concentration of a target component in the blood specimen using the standard component constantly present in the blood, a buffer solution to be used preferably does not contain sodium ions or chloride ions (where a meaning of the phrase, "does not contain" is as already described). Such a buffer solution preferably contains at least one amino alcohol compound selected from the group consisting of 2-amino-2-methyl-1-propanol (AMP), 2-ethylamino ethanol, N-methyl-D-glucamine, diethanolamine, and triethanolamine; and contains a dilute solution containing a buffering agent selected from the group consisting of 2-[4-(2-hydroxyethyl)-1-piperazinyl]ethanesulfonic acid (pKa=7.55), which is also referred to as HEPES that is a Good's buffer solution is a buffering agent having a pKa of around 7.4; N-tris(hydroxymethyl)methyl-2-aminoethanesulfonic acid (pKa=7.50) also called TES; 3-morpholinopropanesulfonic acid (pKa=7.20) also called MOPS; and N,N-bis(2-hydroxyethyl)-2-aminoethanesulfonic acid (pKa=7.15) also called BES. Among them, a combination of 2-amino-2-methyl-1-propanol (AMP) and HEPES, TES, MOPS, or BES is preferable, and furthermore, a combination of 2-amino-2-methyl-1-propanol (AMP) and HEPES is most preferable, pKa represents an acid dissociation constant.

In order to prepare the above buffer solution, it is sufficient that an amino alcohol and a Good's buffer solution is mixed at a concentration ratio of 1:2 to 2:1, preferably 1:1.5 to 1.5:1, and more preferably 1:1. A concentration of the buffer solution is not limited, but a concentration of the amino alcohol or Good's buffer solution is 0.1 mmol/L to 1000 mmol/L, preferably 1 mmol/L to 500 mmol/L, and more preferably 10 mmol/L to 100 mmol/L.

A chelating agent, a surfactant, an antibacterial agent, a preservative, a coenzyme, a saccharide, and the like may be contained in the buffer solution in order to keep an analysis target component stable. Examples of chelating agents include ethylenediamine tetraacetic acid (EDTA) salt, citric acid salt, oxalic acid salt, and the like. Examples of surfactants include a cationic surfactant, an anionic surfactant, an amphoteric surfactant, and a nonionic surfactant. Examples of preservatives include sodium azide, antibiotics, and the like. Examples of coenzymes include pyridoxal phosphate, magnesium, zinc, and the like. Examples of saccharides of an erythrocyte stabilizing agent include mannitol, dextrose, oligosaccharide, and the like. In particular, by adding antibiotics, it is possible to suppress the growth of bacteria partially mixed from a surface of the fingers at the time collecting blood from the fingers, to suppress decomposition of biological components due to bacteria, and to stabilize biological components.

The buffer solution also contains the standard component not present in the blood in the blood test kit for analyzing a target component using a standard component not present in the blood. It is also important not to contain an internal standard substance to be described later and not to interfere with a measurement system of blood analysis.

From the viewpoint of diluting the whole blood, it is possible to prevent hemolysis of blood cells by making an osmotic pressure of the buffer solution to be equal to or more than that of blood (285 mOsm/kg (where, mOsm/kg represents an osmotic pressure that 1 kg water of a solution has, and represents millimolar number of ions)). An osmotic pressure can be isotonically adjusted with salts, saccharides, buffering agents, or the like, which do not affect the measurement of a target component and the measurement of the standard component constantly present in the blood. An osmotic pressure of the buffer solution can be measured by an osmometer.

In a case of testing a specific organ or a specific disease such as liver function, renal function, metabolism, and the like as a blood test, analysis of a plurality of target components to be measured is generally performed at the same time in order to perform a prediction and the like of a state of the organ, a lifestyle habit, and the like by obtaining information of the plurality of target components to be measured which are specific to the organ or the disease. For example, in order to examine the condition of the liver, concentrations of several or more substances in the blood, such as alanine transaminase (ALT), aspartate aminotransferase (AST), γ glutamyl transpeptidase (γ-GTP), alkaline phosphatase (ALP), total bilirubin, total protein, and albumin, are generally measured. As above, in order to measure the plurality of target components from one blood specimen, a certain volume of diluted blood is required in a case of considering a possibility of measuring again. Accordingly, regarding a dilute solution for diluting the collected blood, it is important that a certain volume thereof is secured. However, in consideration of minimizing the invasiveness to a test subject, an amount of blood collected is small, and therefore a dilution factor is, for example, 7 times or more, which is a high rate.

Dilution of Blood Specimen

A cap 424 is removed from the blood collection container 410 of the accommodation instrument 400. The fiber rod 10 that has absorbed the blood specimen by blood collection instrument 100 is introduced into a dilute solution 422 from an upper end opening of the blood collection container 410. The upper end opening of the fiber rod 10 is sealed with the cap 424.

Figure 15:
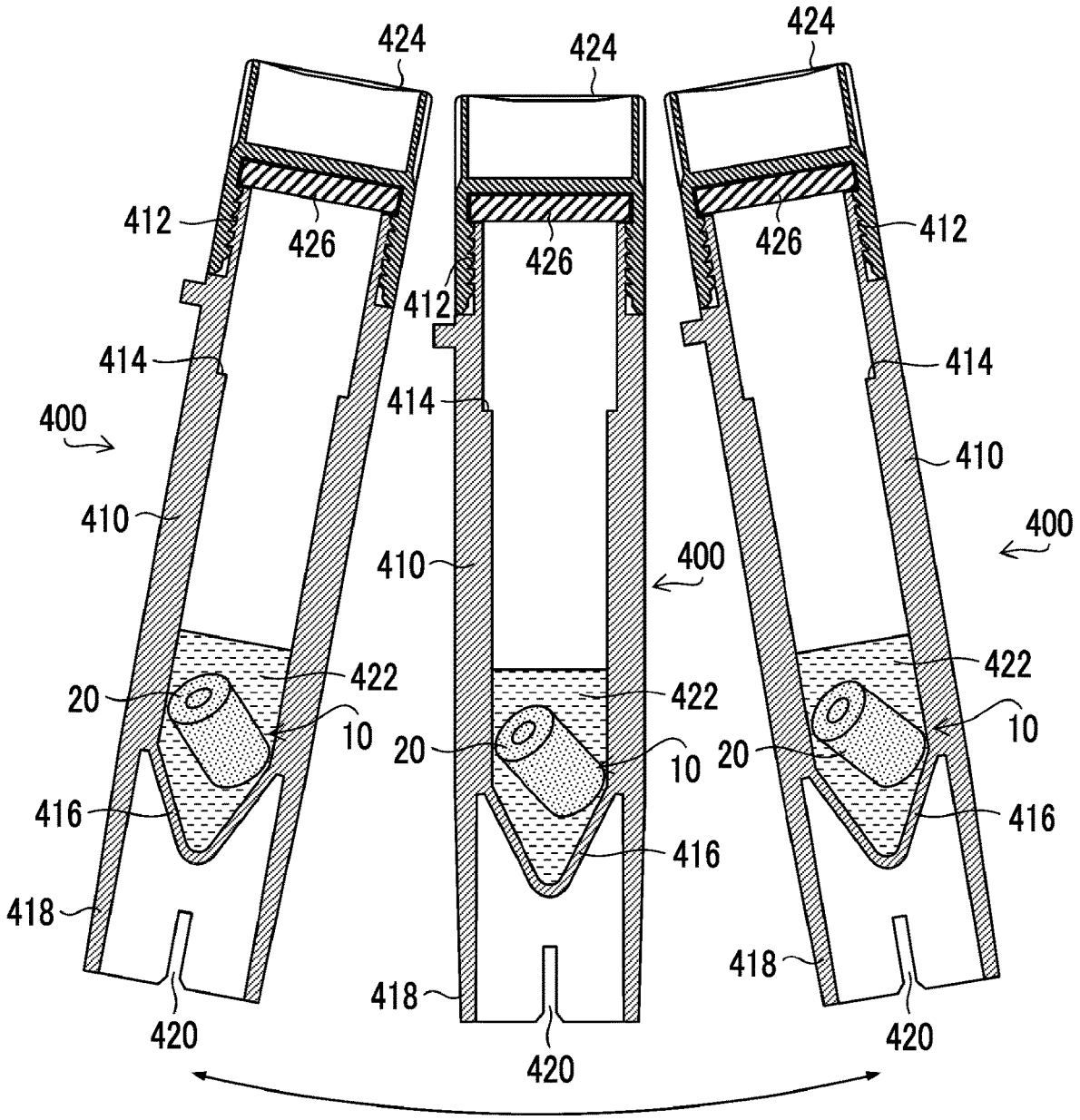
FIG. 15 is a view showing an example of releasing a blood specimen from the fiber rod.

As shown in FIG. 15, an upper portion of the blood collection container 410 is held, the blood collection container 410 is shaken several times in a pendulum shape, and the blood specimen is released from the fiber rod 10 to the dilute solution 422. By diluting the blood specimen into the dilute solution 422, a dilution of the blood specimen is accommodated in the accommodation instrument 400.

The fiber rod 10 of the embodiment includes the fiber portion 20 which is composed of the first fiber and the second fiber having different fiber diameters and which has a void volume within a range of 90% to 97%, in which a distance between surfaces facing each other of the fiber portion includes a region within a range of 1 mm to 1.6 mm, and therefore the blood specimen can be easily released to the dilute solution 422. In addition, in a case where the space 32 is defined in the fiber portion 20, the outer surface 36 and the inner surface 38 of the fiber portion 20 come into contact with the dilute solution 422, and therefore more blood specimens can be released.

In a case where the dilute solution 422 turns red as a whole, shaking of the blood collection container 410 is ended.

Separation Instrument

The blood specimen collected by the blood collection instrument 100 may have been in a diluted state for a long time in the accommodation instrument 400 until analysis is performed thereon. Meanwhile, for example, in a case where hemolysis of erythrocytes occurs, there is a possibility that substances and enzymes and the like present in the blood cells elute into the plasma or serum, and thus test results are affected; or that the absorption of eluted hemoglobin affects a case of measuring an amount of analysis target component with light information such as optical absorption of the analysis target component. Therefore, it is preferable to prevent hemolysis. For this reason, an aspect in which a separation instrument for separating and recovering plasma from a dilution of a blood specimen is contained in a blood test kit is preferable. A preferred example of the separation instrument is a separation membrane. The separation membrane can be used in the following manner. For example, the separation membrane captures blood cell components, allows plasma components to pass through, separates blood cells, and recovers the plasma components by applying pressure to a dilution of a blood specimen. In this case, it is preferable to use an anticoagulant. In addition, in order to ensure the measurement accuracy, it is preferable that the plasma which has passed through the separation membrane does not flow back to the blood cell side. In order to realize this, specifically, a backflow prevention means disclosed in JP2003-270239A can be used as a component of the kit.

Figure 16:
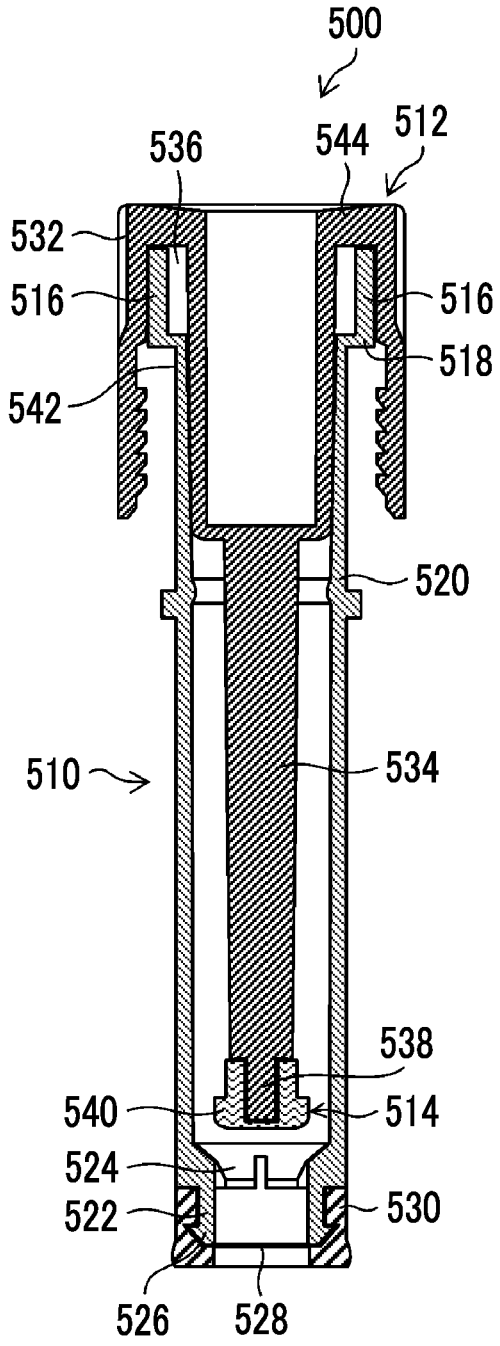
FIG. 16 is a view showing an example of a holding tool for holding a separation instrument.

FIG. 16 is a view showing an example of a holding tool for holding the separation instrument. As shown in FIG. 16, a holding tool 500 comprises a cylinder 510 that can be fitted into the blood collection container 410 of the accommodation instrument 400, a cap piston 512 attached to the cylinder 510, and a sealing lid 514 functioning as a sealing instrument provided at a lower end of the cap piston 512.

The cylinder 510 is made of a transparent material and has a cylindrical shape. A diameter expanding portion 516 is formed at an upper end portion 542 of the cylinder 510. The diameter expanding portion 516 is connected to a main body portion 520 via a thin-walled portion 518. A diameter reducing portion 522 is formed at a lower end portion of the cylinder 510. An engaging protrusion portion 524 is formed on an inner surface of the diameter reducing portion 522. Furthermore, an outer flange portion 526 is formed at a lower end portion of the diameter reducing portion 522. A lower end opening portion of the outer flange portion 526 is covered with a filtration membrane 528 functioning as a separation instrument. The filtration membrane 528 is configured to allow plasma in the blood to pass through and to block passage of blood cells. A cover 530 made of silicone rubber is mounted on an outer periphery of the diameter reducing portion 522.

The cap piston 512 is configured of a substantially cylindrical handle portion 532 and a mandrel portion 534 which is concentric with the handle portion 532 and extends downward. A cylindrical space 536 into which the diameter expanding portion 516 of the cylinder 510 can be fitted is formed at an inner upper end portion of the handle portion 532, and a lower side thereof is threaded and can be screwed into a screw. A lower end portion 538 of the mandrel portion 534 is formed in a pin shape, and a sealing lid 514 is attachably and detachably provided on the lower end portion 538. The sealing lid 514 is made of silicone rubber. A substantially cylindrical shape in which the lower end portion of the sealing lid 514 is formed in an outer flange shape, and a level difference portion 540 is formed over the outer periphery. The handle portion 532 has a top portion 544, and an inner surface of the top portion 544 and the diameter expanding portion 516 are in contact with each other.

Figure 17:
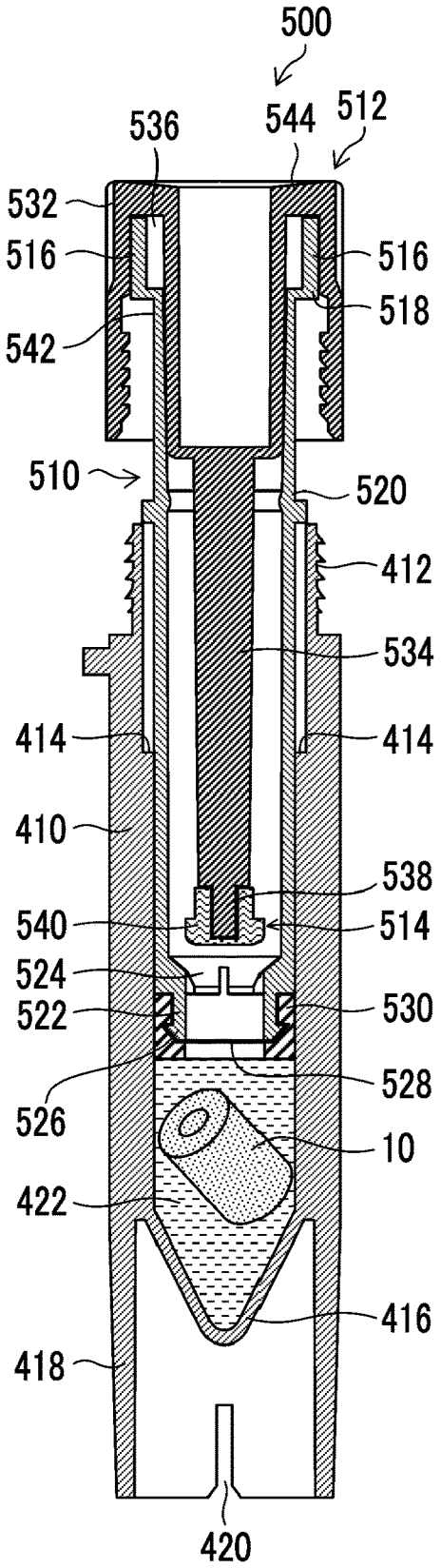
FIG. 17 is a cross-sectional view showing an action of the separation instrument.

Next, as shown in FIG. 17, a cap 424 and a packing 426 are removed from the blood collection container 410, from the blood collection container 410 in which the fiber rod 10 and a dilution of the blood specimen are contained. In this state, the cylinder 510 to which the cap piston 512 is attached is fitted into the blood collection container 410.

Figure 18:
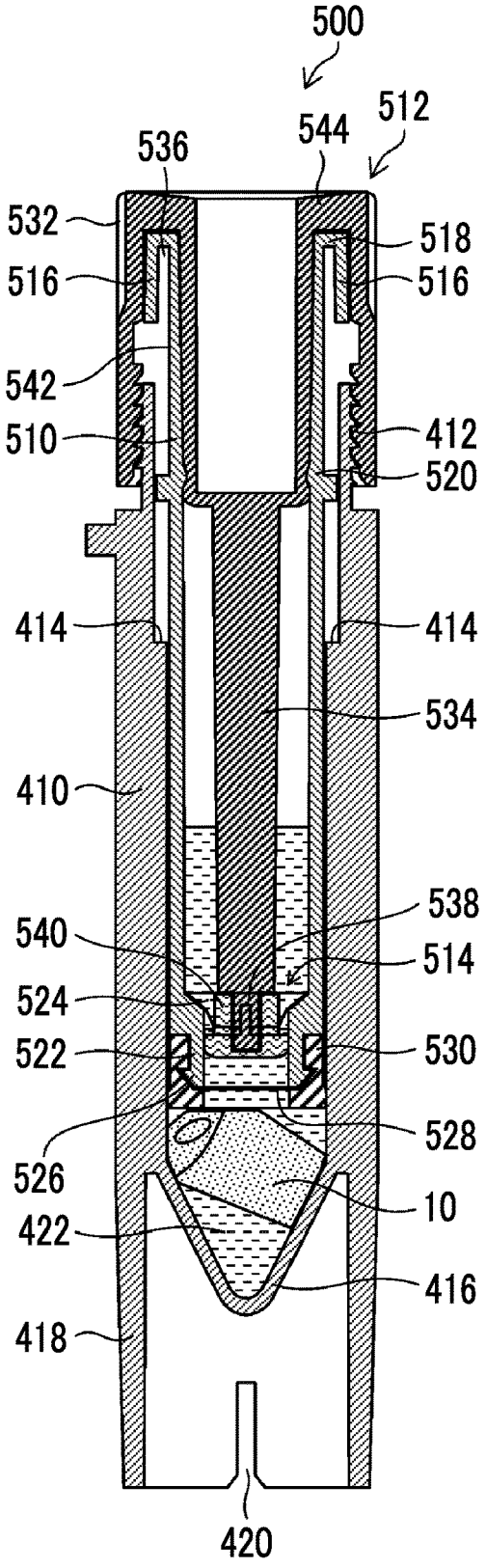
FIG. 18 is a cross-sectional view showing an action of the separation instrument.

Next, as shown in FIG. 18, a handle portion 532 is screwed into a screw portion 412. Initially, the handle portion 532 and the cylinder 510 rotate. In a case where the engaging portion 414 of the blood collection container 410 is engaged with a stopper portion (not shown) formed on an outer peripheral surface of the cylinder 510, the rotation of the cylinder 510 is restrained, and the thin-walled portion 518 is broken by twisting. As a result, the cylinder 510 is separated into a main body portion 520 and a diameter expanding portion 516. Furthermore, in a case where the handle portion 532 is rotated, an upper end portion 542 of the main body portion 520 enters a space 536 inside the diameter expanding portion 516. Because the cylinder 510 is pressed downward by an inner surface of a top portion 544 of the handle portion 532, the cylinder 510 further descends.

As the cylinder 510 descends, a filtration membrane 528 held by the cylinder 510 moves toward the side of the bottom portion 416 of the blood collection container 410. In this case, the plasma moves through the filtration membrane 528 to the side of the cylinder 510, and the blood cells cannot pass through the filtration membrane 528 and remain on the side of the blood collection container 410.

Because an outer diameter of a cover 530 is larger than an outer diameter of the main body portion 520 of the cylinder 510, the cylinder 510 descends in a state of being close contact with the inner surface of the blood collection container 410. Accordingly, in the process of fitting the cylinder 510 into the blood collection container 410, there is no possibility that the dilute solution 422 in the blood collection container 410 leaks to the outside through a gap between the blood collection container 410 and the cylinder 510.

In a case where the handle portion 532 is screwed to the screw portion 412 to the lowermost part, the sealing lid 514 is fitted into the diameter reducing portion 522. A flow path between the blood collection container 410 and the cylinder 510 is hermetically sealed by the sealing lid 514. The sealing lid 514 prevents mixing of plasma and blood cells due to back flow.

The blood collection container 410 constitutes an accommodation instrument in which the dilute solution is accommodated, and also constitutes an accommodation instrument for accommodating a dilution of the blood specimen. In addition, in a state where the cylinder 510 is fitted into the blood collection container 410 to separate the plasma and blood cells, the cylinder 510 constitutes an accommodation instrument for accommodating the recovered plasma. The accommodation instrument for accommodating the blood specimen corresponds to a combination of the blood collection container 410 and the cylinder 510. In other words, one or two or more accommodation instruments for accommodating the diluted blood specimen may be used in combination.

The blood test kit is capable of realizing a method that can analyze an analysis target component with high measurement accuracy even in a case where an amount of blood collected is 100 μL or less. The blood test kit is preferably a blood test kit including a manual which describes information showing accurate measurement is possible even with a small amount of blood collected, such as 100 μL or less, or showing how much blood specimen should be collected by the fiber rod 10 of the blood collection instrument 100.

Blood Analysis Method

A blood analysis method using the blood test kit of the embodiment will be described. The blood analysis method include an aspect in which the analysis is a medical practice for human beings (action performed by doctors), and an aspect in which the analysis is not a medical practice for human beings (for example, an aspect in which a person collecting blood is a patient himself, and an analyzer is a person other than a doctor, an aspect in which the analysis is for a non-human animal, and the like). The blood analysis method according to the embodiment may be carried out by self-blood collection in which a subject himself collects blood, or may be carried out by general blood collection in which a qualified person such as a doctor uses a syringe to collect blood. As a preferred aspect, a patient himself or herself uses a knife-equipped instrument such as a lancet to damage the skin of the fingertips and the like, and collects blood leaked outside the skin.

A biological sample, which is an analysis target, is blood, and blood is a concept including serum or plasma. Plasma or serum obtained by collecting a small amount of blood by a test subject, diluting with a buffer solution, and separating the blood cells by a filter or through centrifugation, can be preferably used. Components of the blood specimen are preferably a plasma component separated from the blood specimen by separation means. The origin of the blood specimen is not limited to humans, and may be mammals, birds, fish, and the like, which are non-human animals. Examples of non-human animals include horses, cows, pigs, sheep, goats, dogs, cats, mice, bears, pandas, and the like. The origin of a biological sample is preferably human.

As a first aspect of the blood analysis method, a concentration of a target component is analyzed using a standard component constantly present in a blood specimen. The same applies to the standard component constantly present in a blood specimen, as in the explanation in [1].

An occupancy rate of plasma components in blood of a test subject is about 55% as a volume ratio, but varies due to changes in salt intake of the test subject. For this reason, in the embodiment, a dilution factor of the plasma is calculated using a standard value of the standard component constantly present in the plasma, thereby analyzing a concentration of a target component in the plasma in the blood specimen using the calculated dilution factor. As a method for calculating a dilution factor, it is possible to obtain a dilution factor by calculating a dilution factor (Y/X) of the plasma component in the blood specimen, from a measurement value (concentration X) of an external standard substance (for example, sodium ion) in a diluted solution of plasma, and a known concentration value (concentration Y: 142 mmol/L in a case of sodium ion) of the above-mentioned external standard substance (for example, sodium ions) contained in the plasma of the blood specimen. Using this dilution factor, a measurement value (concentration Z) of a target component in a dilute solution of the plasma is measured, and by multiplying this measurement value by the dilution factor, it is possible to measure a concentration [Z×(Y/X)] of an analysis target component actually contained in the plasma of the blood specimen.

A concentration of sodium ions and the like can be measured by, for example, a flame photometric method, a glass-electrode method, a titration method, an ion selective electrode method, an enzyme activity method, and the like. In a particularly preferred aspect, sodium ions measurement is carried out by the enzyme activity method utilizing that β-galactosidase is activated by sodium ions, and that a sodium ion concentration and galactosidase activity of a sample diluted with a buffer solution is in a proportional relationship.

In addition, in order to confirm whether the blood test kit in which an amount of a standard component derived from the member is defined is actually used, or whether a method for diluting blood and recovering plasma is normally performed, it is preferable that an additional dilution factor is separately obtained from another standard component in plasma to check whether values thereof match with the dilution factor obtained above. The term "match" means, with respect to two measurement values (a, b), a ratio of their differences to their average values, that is, $|a-b|/\{(a+b)/2\}\times 100$ is 20% or smaller, preferably 10% or smaller, and more preferably 5% or smaller. Accordingly, it is possible to verify that the analysis of a concentration of a target component in a blood specimen is normally performed. Examples of the standard component constantly present in the plasma, which is other than sodium ions and chloride ions are preferably selected from total protein or albumins, and it is more preferable that the component is total protein. Examples of a method for measuring total protein include the known method such as the biuret method, the ultraviolet absorption method, the Bradford method, the Lowry method, the bicinchoninic acid (BCA) method, and the fluorescence method, and it is possible to select a method to be used appropriately depending on characteristics, sensitivity, specimen amount, and the like of a measurement specimen.

As a second aspect of the blood analysis method, a concentration of a target component is analyzed using a standard component not present in blood. In this case, a blood test kit containing a dilute solution containing a standard component not present in the blood is used.

As a third aspect of the blood analysis method, a concentration of a target component is analyzed using a standard component constantly present in blood and a standard component not present in the blood. By using two standard components in combination, it is possible to perform a more reliable analytical method.

Using sodium ions as a standard component constantly present in blood and lithium ions as a standard component not present in blood, in a case where sodium ions measurement is carried out by the enzyme activity method (to be described later) utilizing that β-galactosidase activity is in a proportional relationship, and lithium ions measurement is carried out by the chelate colorimetric method (to be described later), a dilution factor of the blood specimen in this case can be calculated by any one of Formulas 1 to 4.

$$X=(A+C)/(B+D) \quad \text{Formula 1:}$$

$$X=\{(A^2+C^2)^{1/2}\}/\{(B^2+D^2)^{1/2}\} \quad \text{Formula 2:}$$

$$X=a\times(B+D)\pm b \quad \text{Formula 3:}$$

(where a and b are coefficients, and data of a dilution factor and (B+D) is acquired in advance to create a standard curve represented in Formula 3.)

$$X=A/B' \quad \text{Formula 4:}$$

(where B'=(A×D/C))

In the above formulas, A, B, C, D, B', and X are defined as follows.

A: Absorbance in a case of coloring a buffer solution

B: Absorbance change after adding plasma

C: Absorbance at a median value of 142 mmol/L of plasma sodium

D: Absorbance at a concentration of sodium ions after diluting plasma

B': Correction value of an absorbance of a standard component not present in the blood of diluted plasma obtained by a dilution factor calculated from an absorbance of plasma sodium X: Dilution factor of plasma As another calculation method for a case of obtaining a dilution factor, an aspect in which a dilution factor is calculated by Formula 5 using the root-mean-square method, a concentration of an analysis target component in a dilute solution is multiplied by the dilution factor calculated by Formula 5, and therefore a concentration of a target component in the components in a blood specimen is analyzed, is preferable.

$$X=[\{(A/B)^2+(C/D)^2\}/2]^{1/2} \quad \text{Formula 5 (1)}$$

A concentration of a target component in the components of the blood specimen can be calculated from a concentration of a target component of the dilute solution based on the above dilution factor.

The analysis target component is not limited, and any substance contained in a biological sample is targeted. Examples thereof include biochemical test items in blood used for clinical diagnosis, markers of various diseases such as tumor markers and hepatitis markers, and the like, and include proteins, sugars, lipids, low molecular weight compounds, and the like. In addition, not only a concentration of a substance is measured, but also an activity of a substance having an activity such as an enzyme is targeted. Measurement of each target component can be carried out by a known method.

In a case of measuring sodium ions, it is possible to use an enzymatic assay by which sodium ions in several μL of a specimen of very low sodium concentration (24 mmol/L or less) diluted with a buffer solution are measured by utilizing that the enzyme activity of the enzyme galactosidase is activated by sodium ions. This method can be applied to a biochemical/automated immunoassay analyzer, and is highly efficient and economical for not required of another measuring instrument for sodium ions measurement.

EXAMPLES

Hereinafter, the present invention will be described in more with reference to examples of the present invention. However, the present invention is not limited to these examples at all.

Level 1

A cylindrical fiber rod which is composed of two kinds of fibers having a fiber diameter (3.3 dtex) of 17.98 μm and a fiber diameter of 25.43 μm (6.6 dtex), and which has a diameter of 4.3 mm and a height of 5.6 mm was prepared. The fiber rod does not a hollow structure defining a space.

Level 2

A fiber rod that is the same as that of the level 1 was prepared.

Level 3

A cylindrical fiber rod which is composed of two kinds of fibers having a fiber diameter (3.3 dtex) of 17.98 μm and a fiber diameter of 25.43 μm(6.6 dtex), and which has a diameter of 4.5 mm and a height of 5.0 mm, and which has a hollow structure in which a space having an inner diameter of 1.3 μm was formed, was prepared. A distance A between an inner surface and an outer surface was 1.6 mm.

Level 4

A fiber rod that is the same as that of the level 3 was prepared.

Level 5

A cylindrical fiber rod which is composed of only a fiber having a fiber diameter (3.3 dtex) of 17.98 μm, and which has a diameter of 4.3 mm and a height of 5.6 mm was prepared. The fiber rod does not a hollow structure defining a space.

Evaluation

After absorbing a blood specimen on the fiber rods of the levels 1 to 5, the fiber rod was loaded into a dilute solution accommodated in an accommodation instrument. The accommodation instrument was shaken 40 times. At the time where the accommodation instrument was shaken 10 times, 20 times, and 40 times, a density (g/dL) of the dilute solution was measured.

Figure 19:
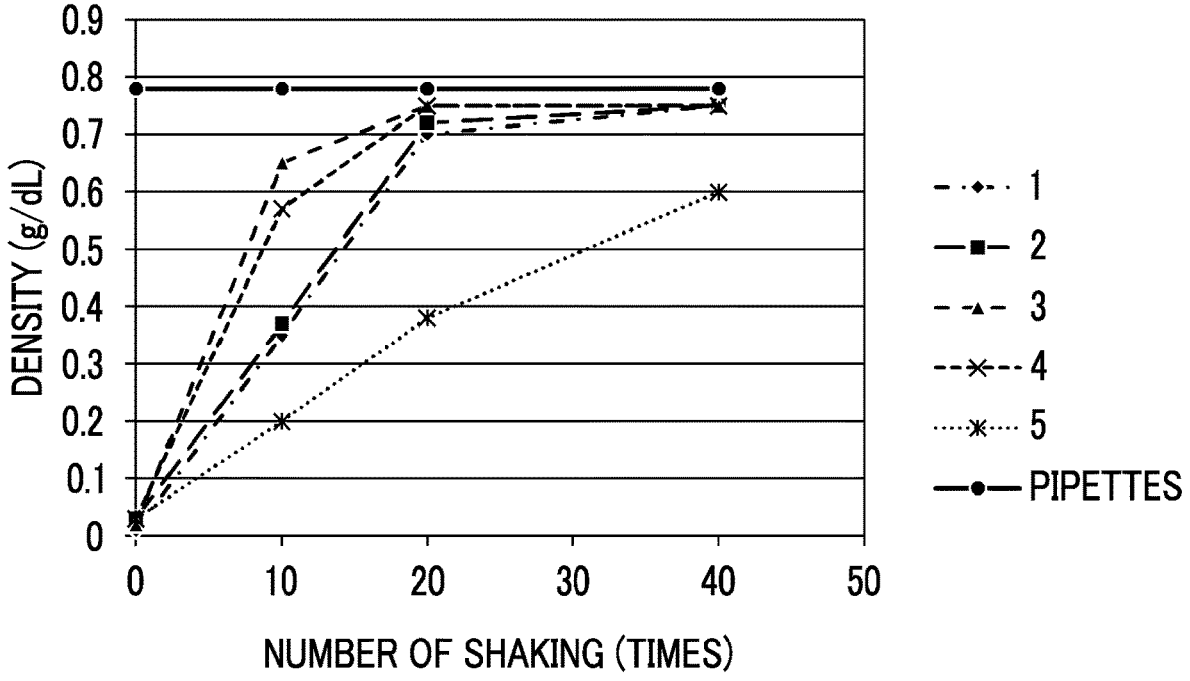
FIG. 19 is a graph plotting measurement results with the number of shaking being a lateral axis and a density being a vertical axis.

Table 1 shows measurement results. FIG. 19 is a graph plotting measurement results with the number of shaking being a lateral axis and a density being a vertical axis. A pipette on the graph shows a case of directly dispensing from the pipette into the dilute solution.

Based on the results of Table 1 and the graph of FIG. 19, according to the levels 3 and 4, 75% or more of the blood specimen contained in the fiber rod was released at the time of 10 times, and 100% of the blood specimen contained in the fiber rod was released at the time of 20 times.

Meanwhile, for the levels 1 and 2, 50% or less of the blood specimen contained in the fiber rod was released at the time of 10 times, but not 100% of the blood specimen contained in the fiber rod was released at the time of 20 times.

As can be seen from the results of the fiber rods of the levels 3 and 4, it can be understood that a release performance is improved by setting the distance A between the surfaces facing each other to 1.6 mm. It can be easily understood that the smaller the distance A is, the easier it is to improve the release performance, and a fiber rod having an excellent release performance can be obtained by setting the distance A from 1.0 mm to 1.6 mm.

TABLE 1

Unit (g/dL)

| Number of times | Level 1 | Level 2 | Level 3 | Level 4 | Level 5 |
|---|---|---|---|---|---|
| 0 | 0.01 | 0.03 | 0.02 | 0.03 | 0.03 |
| 10 | 0.35 | 0.37 | 0.65 | 0.57 | 0.20 |
| 20 | 0.70 | 0.72 | 0.75 | 0.75 | 0.38 |
| 40 | 0.75 | 0.75 | 0.75 | 0.75 | 0.60 |

EXPLANATION OF REFERENCES

10: fiber rod
20: fiber portion
22: surface
24: side surface
26: bottom surface
28: surface
30: end surface
32: space
34: bottom surface
36: outer surface
38: inner surface
40: space
42: bottom surface
44: outer surface
46: inner surface
100: blood collection instrument
110: case
112: opening

114: distal end accommodation portion
116: central portion
118: flange portion
120: base end accommodation portion
122: opening
124: member
126: opening
128: slide groove
130: beam member
132: member
200: rod
210: pushing member
212: connecting member
214: operation portion
216: opening
218: protrusion
300: locking lever
310: frame
312: opening
314: leg portion
316: engaging claw
318: lever
320: lever claw portion
322: lever operation portion
400: accommodation instrument
410: blood collection container
412: screw portion
414: engaging portion
416: bottom portion
418: leg portion
420: slit groove
422: dilute solution
424: cap
426: packing
500: holding tool
510: cylinder
512: cap piston
514: sealing lid
516: diameter expanding portion
518: thin-walled portion
520: main body portion
522: diameter reducing portion
524: engaging protrusion portion
526: outer flange portion
528: filtration membrane
530: cover
532: handle portion
534: mandrel portion
536: space
538: lower end portion
540: level difference portion
542: upper end portion
544: top portion
$F_1$: flow path
$F_2$: flow path

What is claimed is:

1. A fiber rod which is used in a blood collection instrument in a blood test kit, the fiber rod comprising:

a fiber portion which is composed of a first fiber and a second fiber having different fiber diameters and which has a void volume within a range of 90% to 97%, wherein a distance between surfaces facing each other of the fiber portion includes a region within a range of 1 mm to 1.6 mm, wherein the first fiber has a fiber diameter of 22 μm to 29 μm, and the second fiber has a fiber diameter of 14 μm to 21 μm.

2. The fiber rod according to claim 1, wherein the fiber portion has a hollow structure defining a space therein, and a ratio of a volume of the space to a volume of the fiber portion is within a range of 0.4 to 1.0.

3. The fiber rod according to claim 2, wherein the space is a through-hole.

4. The fiber rod according to claim 1, wherein the first fiber and the second fiber are polyester fibers.

5. A blood collection instrument which is used in a blood test kit, the blood collection instrument comprising:

a case in which an opening is defined on one side; and the fiber rod according to claim 1, which is attachably and detachably held on the opening side, in an inside of the case.

6. The blood collection instrument according to claim 5, wherein the case includes a member along an axial direction, and the member and the fiber rod form a flow path of a blood specimen.

7. The blood collection instrument according to claim 5, wherein the case includes a pushing rod which is positioned on a side opposite to the opening and which slides toward the opening side.

8. A blood test kit comprising:

the blood collection instrument according to claim 5, for collecting a blood specimen;

a dilute solution for diluting the collected blood specimen; and an accommodation instrument for accommodating a dilution of the blood specimen, wherein a concentration of a target component in the blood specimen is analyzed using a standard component constantly present in blood or a standard component not present in blood but contained in the dilute solution.

9. The blood test kit according to claim 8, further comprising:

a separation instrument for separating and recovering plasma from the dilution of the blood specimen.

* * * * *